US009488400B2

(12) United States Patent
Him et al.

(10) Patent No.: US 9,488,400 B2
(45) Date of Patent: Nov. 8, 2016

(54) SYSTEM FOR MANAGING LUBRICANT LEVELS IN TANDEM COMPRESSOR ASSEMBLIES OF AN HVAC SYSTEM

(71) Applicant: Lennox Industries Inc., Richardson, TX (US)

(72) Inventors: Aylan Him, Coppell, TX (US); Der-Kai Hung, Dallas, TX (US); David Mackey, Addison, TX (US); Lin Hong, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 347 days.

(21) Appl. No.: 14/293,099

(22) Filed: Jun. 2, 2014

(65) Prior Publication Data

US 2015/0345848 A1 Dec. 3, 2015

(51) Int. Cl.

| | |
|---|---|
| ***F25B 49/02*** | (2006.01) |
| ***F25B 31/00*** | (2006.01) |
| ***F25B 31/02*** | (2006.01) |

(52) U.S. Cl.

CPC ..... *F25B 49/022* (2013.01); *F25B 31/004* (2013.01); *F25B 31/02* (2013.01); *F25B 2400/06* (2013.01); *F25B 2400/075* (2013.01); *F25B 2700/03* (2013.01)

(58) Field of Classification Search

CPC .... F25B 31/002; F25B 31/004; F25B 31/02; F25B 49/022; F25B 2400/03; F25B 2400/06; F25B 2400/075; F25B 2500/16

USPC ..... 62/84, 192, 193, 468

See application file for complete search history.

(56) References Cited

U.S. PATENT DOCUMENTS

| | | | | |
|---|---|---|---|---|
| 4,506,516 | A | 3/1985 | Lord | |
| 7,810,353 | B2 * | 10/2010 | Groll | F25B 1/10 62/324.6 |
| 2009/0084120 | A1 | 4/2009 | Meier et al. | |
| 2010/0186433 | A1 | 7/2010 | Galante | |

OTHER PUBLICATIONS

European Patent Office, Communication for Application No. 15169821.4-1602 5 pages, Nov. 29, 2015.

* cited by examiner

*Primary Examiner* — Marc Norman

(74) *Attorney, Agent, or Firm* — Baker Botts L.L.P.

(57) ABSTRACT

The present invention provides a control system for managing lubricant levels in tandem compressor assemblies of a heating, ventilation, and air conditioning (HVAC) system. In transitioning from a partial load that operates a first compressor but not a second compressor of a tandem assembly to a full load that operates both the first and the second compressor, a controller of the HVAC system turns OFF both compressors of the tandem compressor assembly to allow time for lubricant levels to equalize between the first and the second compressor.

20 Claims, 17 Drawing Sheets

| Stage | Compressor Assembly | | | |
|---|---|---|---|---|
| | Tandem Assembly 1 | | Tandem Assembly 2 | |
| | C1 | C2 | C3 | C4 |
| Y1 | ON | OFF | ON | OFF |
| $T_1$ | OFF | OFF | ON | OFF |
| $T_2$ | ON | ON | OFF | OFF |
| Y2 | ON | ON | ON | ON |

FIG. 9A

| Demand Stage | Compressor Assembly | | | |
|---|---|---|---|---|
| | Tandem Assembly 1 | | Tandem Assembly 2 | |
| | C1 | C2 | C3 | C4 |
| Y0 | OFF | OFF | OFF | OFF |
| Y1 | ON | ON | OFF | OFF |
| Y2 | ON | ON | ON | ON |

FIG. 9B

| Stage | Compressor Assembly | | | |
|---|---|---|---|---|
| | Tandem Assembly 1 | | Tandem Assembly 2 | |
| | C1 | C2 | C3 | C4 |
| Y1 | ON | OFF | OFF | OFF |
| Y2 | ON | OFF | ON | OFF |
| $T_1$ | OFF | OFF | ON | OFF |
| Y3 | ON | ON | ON | OFF |
| $T_2$ | ON | ON | OFF | OFF |
| Y4 | ON | ON | ON | ON |

FIG. 9C

| Demand Stage | Compressor Assembly | | | |
|---|---|---|---|---|
| | Tandem Assembly 1 | | Tandem Assembly 2 | |
| | C1 | C2 | C3 | C4 |
| Y1 | ON | OFF | OFF | OFF |
| Y2 | OFF | OFF | ON | ON |
| Y3 | ON | ON | ON | ON |
| Y4 | ON | ON | ON | ON |

FIG. 9D

| Demand Stage | Compressor Assembly | | |
|---|---|---|---|
| | Tandem Assembly 1 | | 2-Speed |
| | C1 | C2 | C3 |
| Y1 | ON | OFF | LOW |
| $T_3$ | OFF | OFF | HIGH |
| Y2 | ON | ON | HIGH |

FIG. 10A

| Demand Stage | Compressor Assembly | | |
|---|---|---|---|
| | Tandem Assembly 1 | | 2-Speed |
| | C1 | C2 | C3 |
| Y0 | OFF | OFF | OFF |
| Y1 | ON | ON | OFF |
| Y2 | ON | ON | HIGH |

FIG. 10B

| Stage | Compressor Assembly | | |
|---|---|---|---|
| | Tandem Assembly 1 | | 2-Speed |
| | C1 | C2 | C3 |
| Y1 | OFF | OFF | LOW |
| Y2 | ON | OFF | OFF |
| Y3 | ON | OFF | LOW |
| $T_3$ | OFF | OFF | HIGH |
| Y4 | ON | ON | HIGH |

FIG. 10C

| Stage | Compressor Assembly | | |
|---|---|---|---|
| | Tandem Assembly 1 | | 2-Speed |
| | C1 | C2 | C3 |
| Y1 | OFF | OFF | LOW |
| Y2 | OFF | OFF | HIGH |
| Y3 | ON | ON | OFF |
| Y4 | ON | ON | HIGH |

FIG. 10D

SYSTEM FOR MANAGING LUBRICANT LEVELS IN TANDEM COMPRESSOR ASSEMBLIES OF AN HVAC SYSTEM

BACKGROUND OF THE INVENTION

1. Field of the Invention

The present invention relates to compressors used in heating, ventilation, and air conditioning (HVAC) systems and, more particularly, to a system for managing lubricant levels in tandem compressor assemblies of an HVAC system.

2. Description of the Related Art

Some heating, ventilation, and air conditioning (HVAC) systems utilize multi-compressor assemblies, such as tandem assemblies. The compressors of a tandem assembly can be manifolded together allowing them to work simultaneously on the same heating or cooling circuit to deliver pressurized refrigerant to the HVAC system. In some manifold configurations, oil used as a lubricant in the HVAC system is equalized between the compressors of the tandem assembly by an oil equalization system, such as piping between each compressor that maintains an equal oil level in the oil sumps. When both compressors of the tandem assembly are operating, the oil equalization system ensures that oil is transferred between the compressors to prevent starving or overfilling of any one compressor, or other problems.

When one compressor of a tandem assembly is turned off and the other is running, however, refrigerant will likely condense in the oil sump of the idle compressor. Collection of liquid refrigerant in the oil sump dilutes the oil available to the idle compressor, and can cause compressor problems and even failures, when the idle compressor is turned back on. What is needed are lubricant management systems and methods that will improve the reliability and efficiency of compressor assemblies, reducing down time for maintenance and repair, and extending the life of the assembly.

SUMMARY

In at least one mode of operation, a controller of an HVAC system turns off both compressors to allow time for lubricant levels to equalize between the first and the second compressor when the tandem compressor assembly is transitioning from a partial load to a full load.

BRIEF DESCRIPTION OF THE DRAWINGS

For a more complete understanding of the present invention and the advantages thereof, reference is now made to the following Detailed Description taken in conjunction with the accompanying drawings, in which:

FIGS. 9A, 9B, 9C, and 9D are tables showing compressor switching operations of a two-stage and a four-stage HVAC system having dual tandem assemblies; and FIGS. 10A, 10B, 10C, and 10D are tables showing compressor switching operations of a two-stage and a four-stage HVAC system having a tandem compressor assembly operating in conjunction with a single 2-speed compressor.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning well-known elements have been omitted inasmuch as such details are not considered necessary to obtain a complete understanding of the present invention, and are considered to be within the understanding of persons of ordinary skill in the relevant art.

First HVAC System 1000

Figure 1:
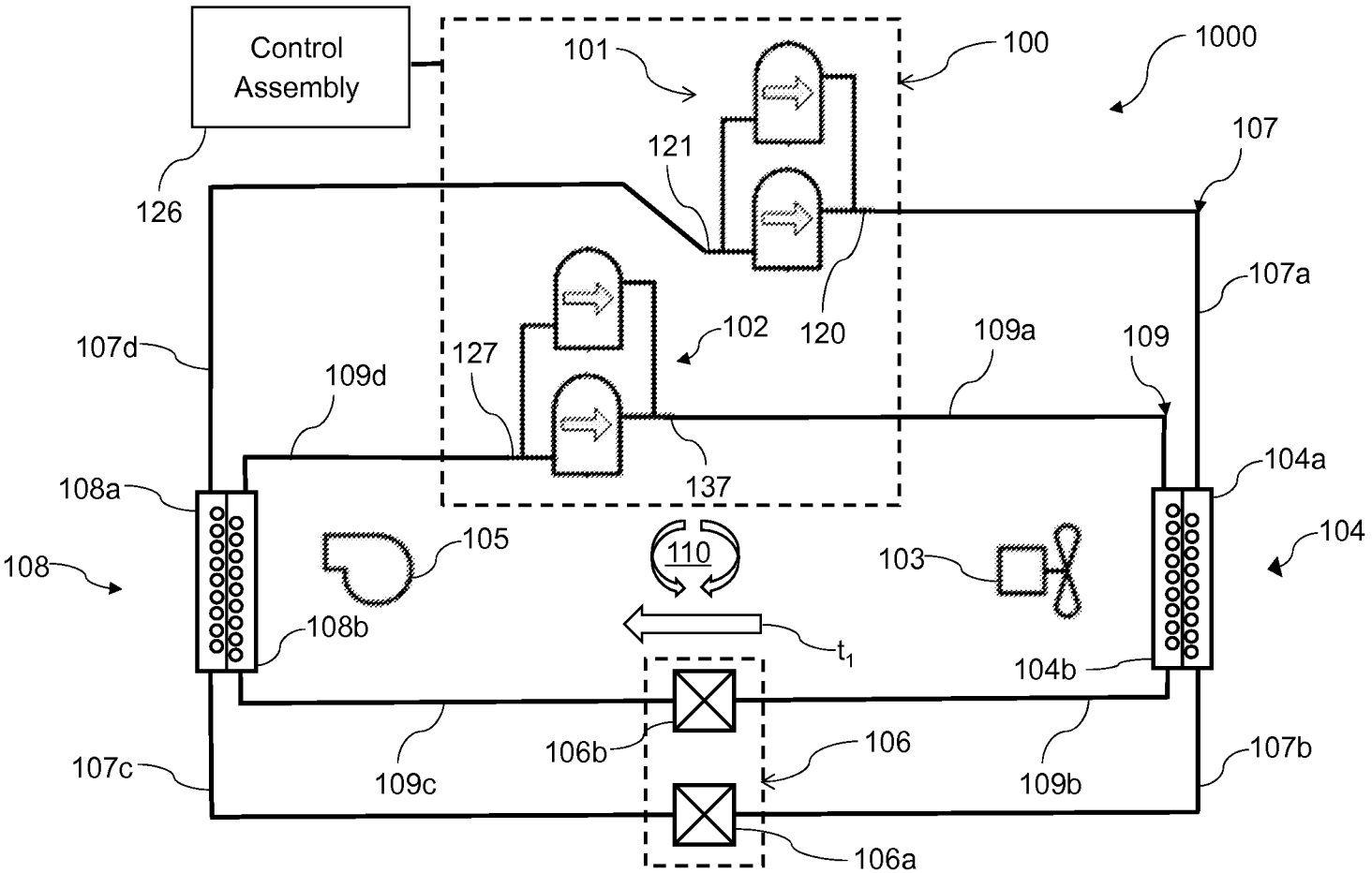
FIG. 1 illustrates a first HVAC system having a first and second compressor assembly.

Referring to FIG. 1, a refrigerant compressor assembly 100 may be configured to operate in a first heating, ventilation, and air conditioning (HVAC) system 1000. The refrigerant compressor assembly 100 may comprise at least one tandem compressor assembly and at least one other compressor assembly. In the embodiments shown in FIGS. 1 and 2, the refrigerant compressor assembly 100 comprises a first compressor assembly 101, shown as a tandem compressor assembly, and a second compressor assembly 102, also shown as a tandem compressor assembly.

The refrigerant compressor assembly 100 may drive refrigerant, as a first heat transfer media, in direction $t_1$ through one or more flow line circuits containing heat transfer devices, e.g. condensers and evaporators. In the embodiment shown, a first flow line circuit 107, shown in segments 107*a-d*, may connect the first compressor assembly 101 to a first condenser portion 104*a* of a condenser 104, to a first expansion valve device 106*a* of an expansion assembly 106, and to a first evaporator portion 108*a* of an evaporator 108. A second flow line circuit 109, shown in segments 109*a-d*, may connect the second compressor assembly 102 to a second condenser portion 104*b* of the condenser 104, to a second expansion valve device 106*b* of the expansion assembly 106, and to a second evaporator portion 108*b* of the evaporator 108.

The condenser 104 and the evaporator 108 may comprise coils containing channels for the transfer of thermal energy between refrigerant flowing in the channels and the environment surrounding the coils. Each condenser 104 and evaporator 108 may be divided into the portions 104*a*, 104*b* and 108*a*, and 108*b*, respectively. Each portion of the condenser 104 and the evaporator 108 may be dedicated to one of the first compressor assembly 101 or the second compressor assembly 102 so that in some configurations only one portion of the evaporator 108 and the condenser 104 may be utilized in a cooling or heating cycle. It will be understood by persons of ordinary skill in the art that the portions of the condenser 104 or the evaporator 108 may comprise parts of the same integrated structure (e.g. one condenser with partitioned portions) or may comprise two separate structures that may be located in different physical locations (e.g. two condensers separately located).

Referring to FIG. 1, a control assembly 126 may be operationally connected to the refrigerant compressor assembly 100 to control operation of the first compressor assembly 101 and the second compressor assembly 102. Other operations of the control assembly 126 may include, but not be limited to, sensing and measuring environmental data, receiving system data, to make calculations based on environmental and system data, reporting the status of the system, issuing commands based on timing functions, timers and clocks, and other operations readily apparent to persons of ordinary skill in the art.

The first HVAC system 1000 may utilize a second heat transfer media in the cooling and heating cycle 110. In some embodiments, the second heat transfer media is air. Air may be pumped or blown by fluid moving devices, such as fan 103 and blower 105, over the coils of the condenser 104 and the evaporator 108, respectively, to facilitate the transfer of thermal energy between the refrigerant flowing in the channels and the environment surrounding the respective heat transfer device. The first HVAC system 1000 may be configured for refrigeration, cooling, and heating in the cooling or heating cycle 110 for maintaining a desired temperature profile in an enclosed space, such as a residential or commercial structure.

First Compressor Assembly 101 and Second Compressor Assembly 102

Figure 2:
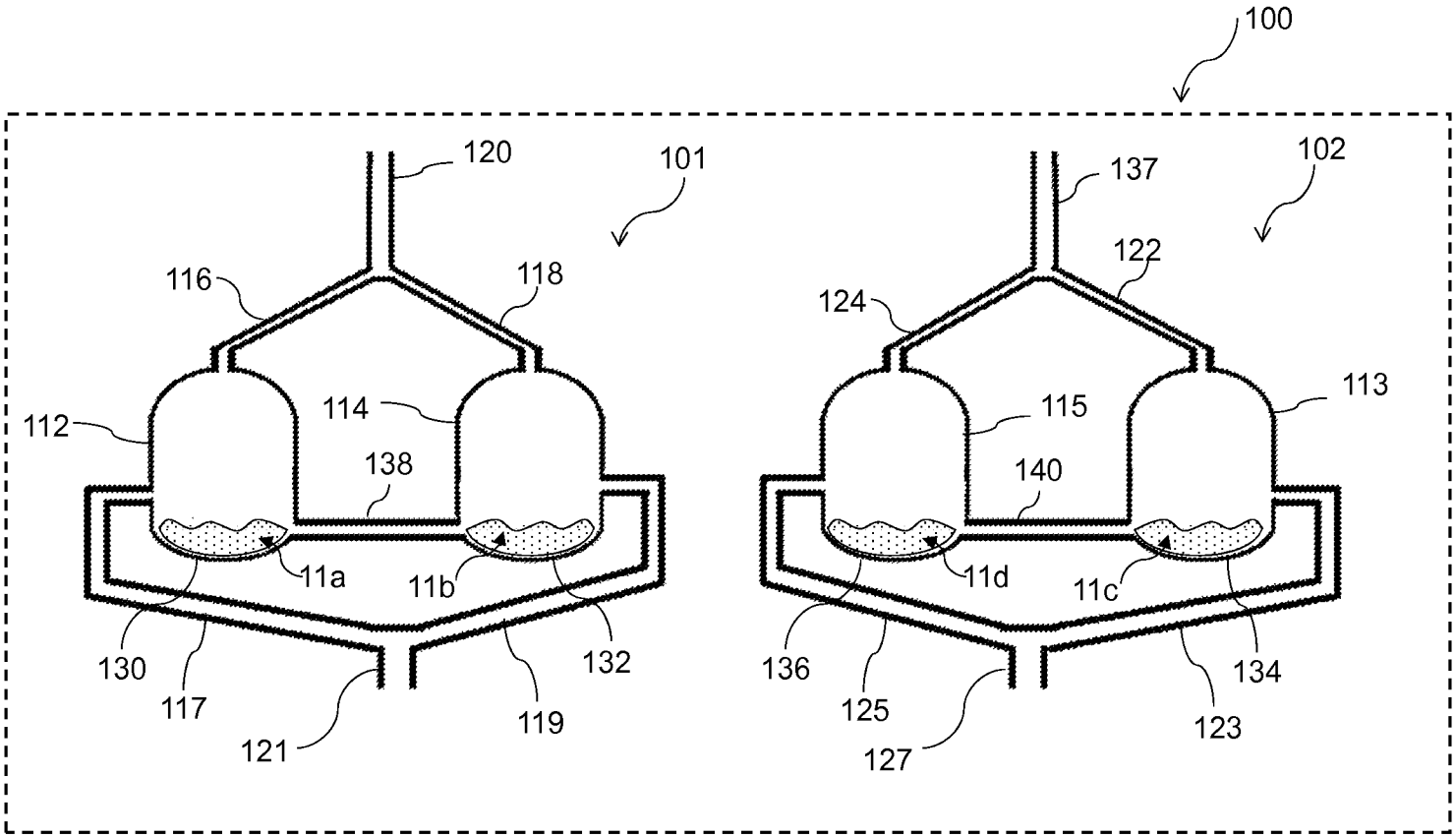
FIG. 2 shows a schematic of the first and second compressor assembly illustrated in FIG. 1.

Referring to FIGS. 1 and 2, each of the first compressor assembly 101 and the second compressor assembly 102 of the refrigerant compressor assembly 100 may comprise one or more compressor units. The first compressor assembly 101 may comprise a first compressor 112 and a second compressor 114 operationally connected in tandem for adjustment of the total heat transfer capacity of the first HVAC system 1000. In some embodiments, the second compressor assembly 102 may comprise a third compressor 113 and a fourth compressor 115 operationally connected in tandem for adjustment of the total heat transfer capacity of the first HVAC system 1000. In other embodiments, the first and second compressor assemblies 101, 102 may comprise two or more compressor units operated in tandem, for example a three compressor system. In still other embodiments, the second compressor assembly 102 may comprise a single compressor assembly, for example a two-speed compressor.

Each compressor of the first compressor assembly 101 and the second compressor assembly 102 may comprise the same or a different total capacity as compared to the other compressors. Each compressor of the first compressor assembly 101 and the second compressor assembly 102 may comprise a fixed capacity (i.e. one speed), a variable capacity, or a staged capacity (e.g. a two-stage capacity).

Referring to FIGS. 1 and 2, the first compressor 112 and the second compressor 114 of the first compressor assembly 101 may be manifolded together such that the compressors 112, 114 share one or more portions of flow line segments 107*a-d* in the same heating or cooling cycle 110. By example, a first discharge line 116 of the first compressor 112 and a second discharge line 118 of the second compressor 114 may be connected by a first common discharge line 120. A first suction line 117 of the first compressor 112 and a second suction line 119 of the second compressor 114 may be connected by a first common suction line 121. Refrigerant pumped into the first compressor 112 via the first suction line 117 and the second compressor 114 via the second suction line 119 from the common suction line 121 may flow out from each respective discharge line 116, 118 into the first common discharge line 120.

In some embodiments, the third compressor 113 and the fourth compressor 115 of the second compressor assembly 102 may also be manifolded together in a tandem configuration to share one or more portions of flow line segments 109*a-d* in the same heating or cooling cycle 110. As shown in FIGS. 1 and 2, discharge lines 122 and 124 of the third and fourth compressors 113 and 115, respectively, are connected by a second common discharge line 137, and suction lines 123 and 125 are connected by a second common suction line 127. Refrigerant pumped into the third compressor 113 and fourth compressor 115 via their respective suction lines 123, 125 from the second common suction line 127 may flow out from each respective discharge line 122, 124 into the second common discharge line 137

Referring to FIG. 1, the first common suction line 121 of the first compressor assembly 101 is configured to receive refrigerant flow from flow line segment 107*d*. Refrigerant is then pumped by the first compressor assembly 101 through the first common discharge line 120, which is configured to transfer refrigerant flow to the flow line segment 107*a*.

Referring again to FIG. 1, the second common suction line 127 of the second compressor assembly 102 is configured to receive refrigerant flow from flow line segment 109*d*. Refrigerant is then pumped by the second compressor assembly 102 through the second common discharge line 137, which is configured to transfer refrigerant flow to the flow line segment 109*a*.

Referring to FIG. 2, each of the first compressor 112 and the second compressor 114 may comprise a first compressor sump 130 and a second compressor sump 132, respectively. In some embodiments, the third compressor 113 and the fourth compressor 115 of the second compressor assembly 102 may comprise sumps 134, 136 respectively. Each compressor sump 130, 132, 134, and 136 is configured as a collection vessel for lubricant 11 (shown as 11*a-d*), e.g. oil, used in the first HVAC system 1000. During periods when one or both of the compressors 112, 114 and 113, 115 of each compressor assembly 101, 102, respectively, are not operating, oil and refrigerant may collect in the compressor sumps 130, 132, 134, and 136 of the compressor(s) that is not operating.

Oil levels may be equalized between the first compressor 112 and the second compressor 114 by a lubricant equalization system. In some embodiments, as shown in FIG. 2, the lubricant equalization system may comprise first tubing 138 that extends between the first compressor 112 and the second compressor 114. The first tubing 138 provides a channel for movement of oil between compressors, which allows the amount of oil in each compressor 112, 114 to equalize between the two compressors. Second tubing 140 shown extending between the third compressor 113 and the fourth compressor 115 may function in a similar manner to the first tubing 138 in allowing oil levels to equalize between the third compressor 113 and the fourth compressor 115.

When one compressor, e.g. the first compressor 112, is running and the other compressor is idle, oil is pulled from the other compressor, e.g. the second compressor 114, into the running compressor. Liquid refrigerant may condense and mix with the oil in the sump of the idle compressor (e.g. sump 132), diluting the oil available to the idle compressor, and reducing the lubricating quality of the oil present in the compressor.

Control Assembly 126

Figure 3:
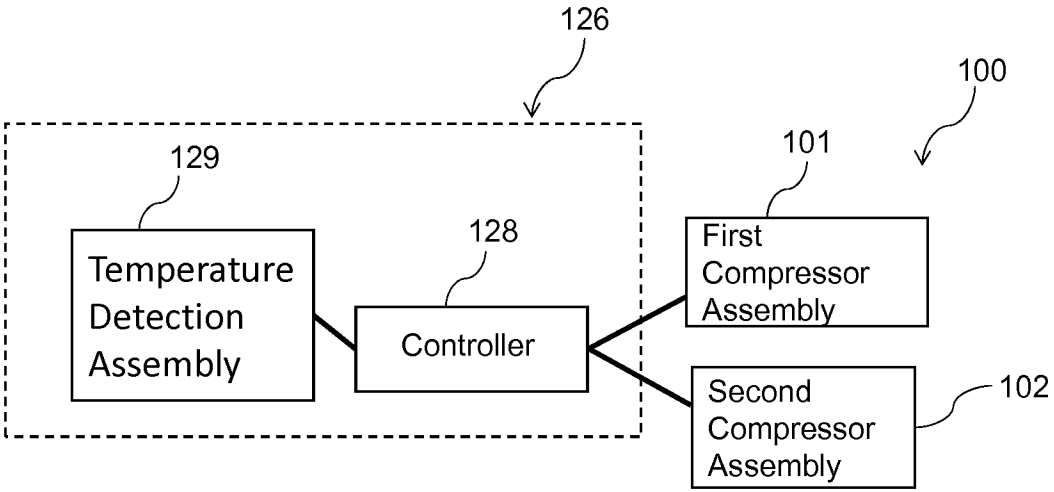
FIG. 3 shows a schematic of a control assembly operationally connected to a first and second compressor assembly.

Referring to FIG. 3, a control assembly 126 may be operationally connected to the refrigerant compressor assembly 100. The control assembly 126 may further comprise a controller 128 operationally connected to the refrigerant compressor assembly 100 configured to control operation of the refrigerant compressor assembly 100.

Referring to FIG. 3, the control assembly 126 may further comprise the controller 128 operationally connected to the temperature detection assembly 129. The temperature detection assembly 129 may be configured to detect the ambient temperature, which is the temperature outside an environmentally controlled space (shown as space 10 in FIG. 4). The controller 128 may be further configured to determine the sump superheat of the first and second compressor assemblies 101, 102 based on the saturated suction temperature and the ambient temperature, which it is assumed is roughly equal to the temperature of the sump of an idle compressor.

Figure 4:
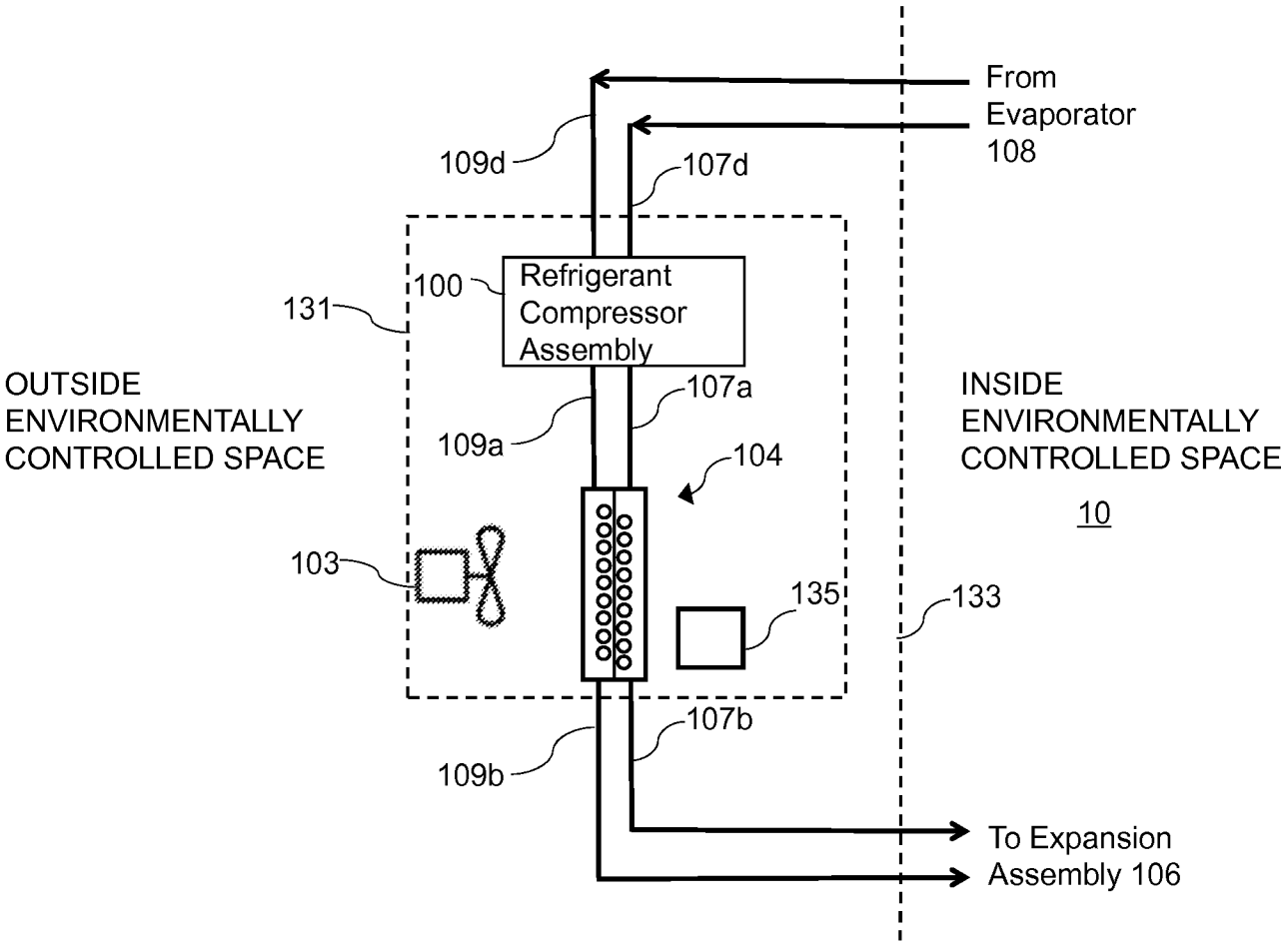
FIG. 4 shows a portion of an HVAC system relative to an environmentally controlled space.

Referring to FIGS. 3 and 4, in some embodiments, the temperature detection assembly 129 may comprise a temperature detection device, such as a thermostat 135. The thermostat 135 may comprise a component of an outside unit 131. In other embodiments, the temperature detection device may comprise a digital sensor from part of a direct digital control (DDC) system, a zone sensor or other device configured to detect the ambient temperature. In some embodiments, the sump superheat may be more accurately determined by adding a pressure transducer to the suction line of the idle compressor to measure suction pressure and measuring the temperature of the sump by direct measurement with for example a thermostat mounted on or near the sump.

In some embodiments, as shown in FIG. 4, the outside unit 131 comprises the compressor assembly 100 and the condenser 104, which is configured to receive flow of a second heat transfer media (e.g. air) from the fan assembly 103. The outside unit 131 may be positioned outside of the walls 133 of the environmentally controlled space 10 to facilitate the transfer of heat between inside and outside the space 10 via refrigerant flow lines (e.g. flow line segments 107*b*, 107*d* and 109*b*, 109*d*).

Mode Transition Temperature

Figure 5A:
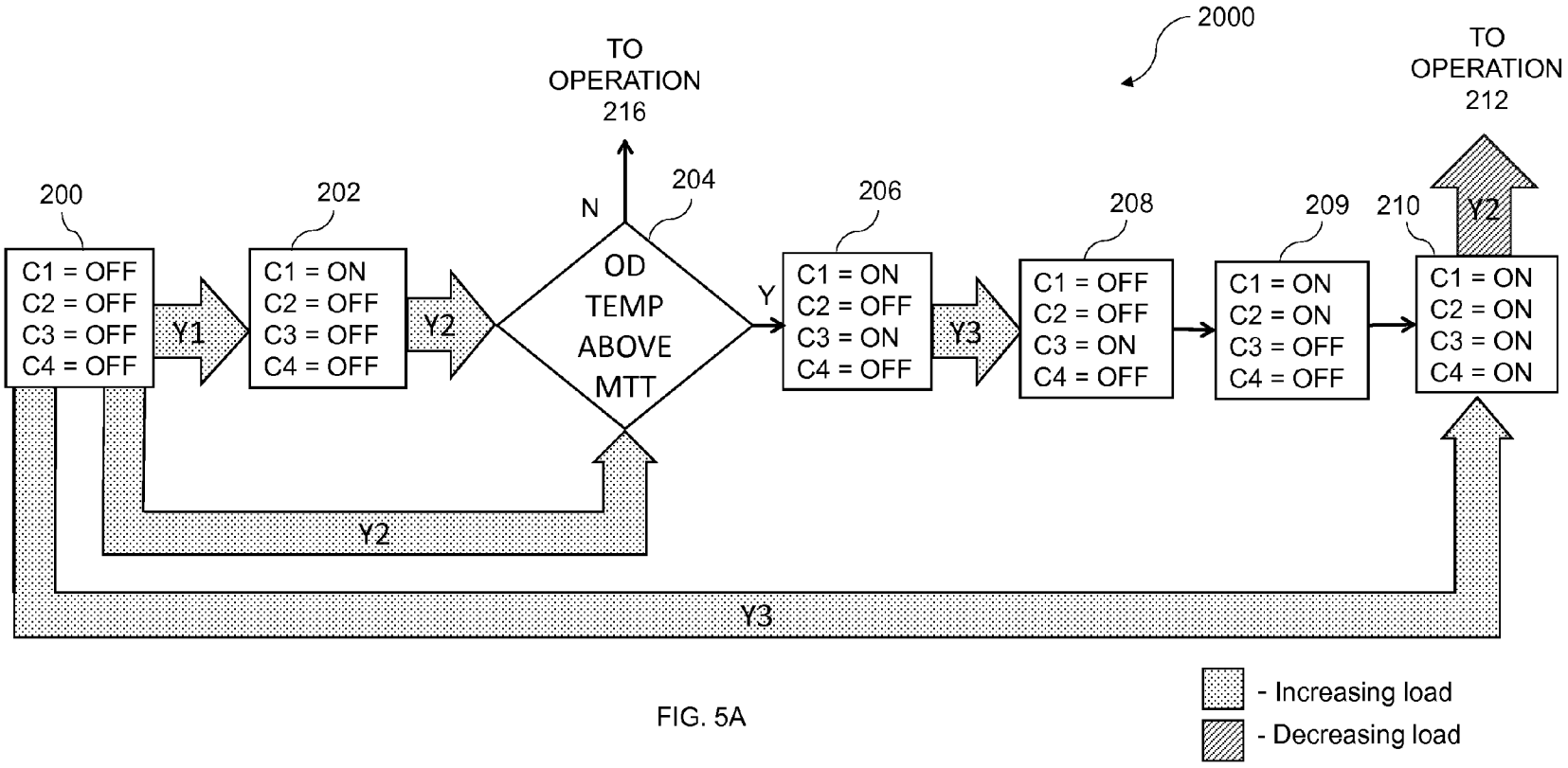
FIGS. 5A, 5B, and 5C show a flow chart of operations of a first method for managing lubricant levels in a multi-compressor assembly in an HVAC system.
Figure 5B:
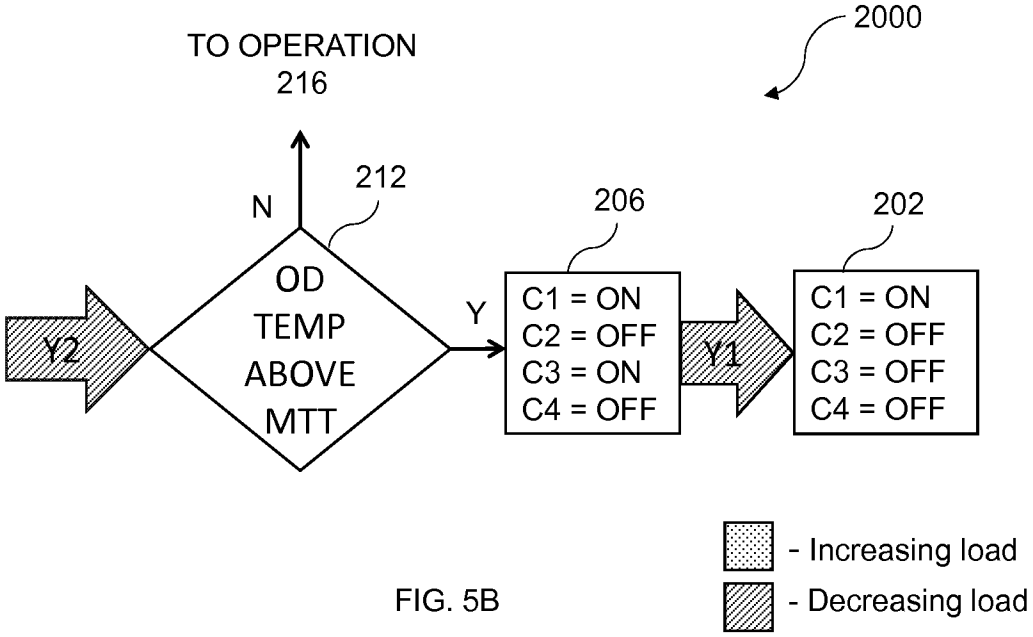
Figure 5C:
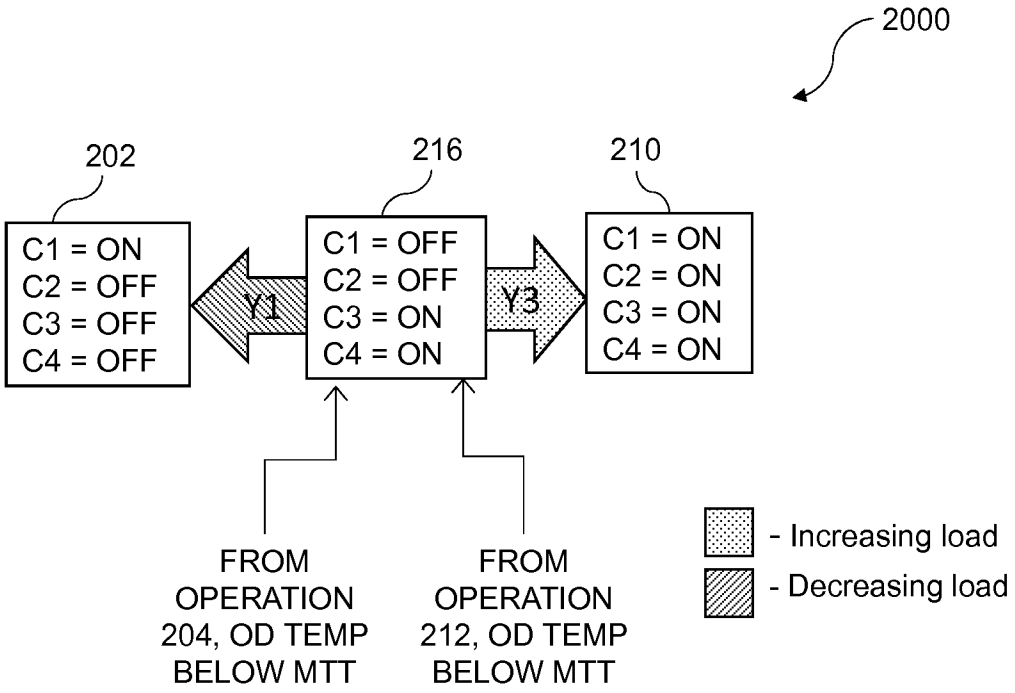

Referring to FIGS. 5A, 5B, and 5C (referred to collectively as "FIG. 5"), a first method 2000 for managing lubricant levels in a tandem compressor assembly of an HVAC system may comprise the first HVAC system 1000 of FIGS. 1-4 configured to respond to measurement of an environmental condition, such as an ambient temperature at or below a mode transition temperature.

The mode transition temperature may be determined based on sump superheat, which is the relationship between the environmental conditions, such as ambient temperature, and the saturated suction temperature. The sump superheat of a compressor is derived by subtracting the saturated sump temperature, which is approximately the saturated suction temperature, from the sump temperature, which in some embodiments is approximated as the ambient temperature. The higher the sump superheat the lower potential for refrigerant to condense as a liquid in the compressor sump.

It may be assumed that the ambient temperature and the temperature of the sumps when the compressors are idle 112, 114 and 113, 115 of each of the first compressor assembly 101 and the second compressor assembly 102, respectively, are about the same. The mode transition temperature may be selected based on the conditions of operation of the first HVAC system 1000, and may be based on the ambient temperature at which the sump superheat drops below about 20 degrees Fahrenheit.

A low sump superheat may allow liquid refrigerant to collect in the sump of an idle compressor. Sump superheat for an idle compressor in a tandem assembly where the other compressor(s) is running may be in the range of 0 (zero) to 20 (twenty) degrees Fahrenheit for ambient temperatures below 65 (sixty-five) degrees Fahrenheit and in the 20 (twenty) degrees Fahrenheit and above for ambient temperatures above 65 degrees Fahrenheit.

In some embodiments, the mode transition temperature may be selected to be about 65 degrees Fahrenheit, with a tolerance of about plus or minus 2 (two) degrees Fahrenheit to account for environmental conditions and other known factors. When one of the compressors of a tandem compressor assembly is running, the saturated suction temperature will equalize across all compressor sumps in the assembly. The sump temperature of the idle compressor, at this ambient temperature, is typically at or above 65 (sixty-five) degrees Fahrenheit, while the saturated suction temperature of the idle compressor assembly is typically about 45 (forty-five) degrees Fahrenheit. In this scenario, the sump superheat of the idle compressor is equal to or greater than about 20 (twenty) degrees Fahrenheit.

As ambient temperature drops, the sump superheat of the idle compressor drops, which raises the amount of liquid refrigerant and oil that collects in the sump of the idle compressor. The mode transition temperature may correspond to the operational state of the tandem compressor assembly, including the saturated suction temperature, where the sump superheat is at or above about 20 degrees Fahrenheit.

Method 2000 for Managing Lubricant Levels in an HVAC System

Referring to FIGS. 5A, 5B, and 5C (referred to collectively as "FIG. 5"), the first method 2000 may comprise one or more operations for operating the first HVAC system 1000 in at least two modes based on the mode transition temperature. At temperatures at or above the mode transition temperature, the first HVAC system 1000 may be operated in a first mode. The first mode may be configured to operate the first HVAC system 1000 with the objective of maximizing efficiency by operating one compressor in a tandem compressor assembly (e.g. the first compressor assembly 101 or the second compressor assembly 102) when there is only a partial load demanded on the first HVAC system 1000. In some embodiments, the At temperatures below the mode transition temperature, the first HVAC system 1000 may be operated in a second mode. The second mode may be configured to operate the first HVAC system 1000 with the objective of extending compressor life and system reliability.

The mode transition temperature, and its corresponding range, may be adjusted to accommodate environmental and operating conditions of the first HVAC system 1000. The mode transition temperature may be affected by operating and environmental conditions, including but not limited to conditions of the air inside the environmentally controlled space, idling time of the compressors, and the air flow rate of the indoor blower 103. In some embodiments, the controller 128 may be configured to measure the real-time sump temperature and suction pressure to determine whether the first HVAC system 1000 should operate in the first mode or the second mode based on the measured ambient temperature.

In operation 200 of the first method 2000 shown in FIG. 5, the first HVAC system 1000 may comprise a pre-demand state, where the first compressor 112 (referred to as "C1" in FIG. 5), the second compressor 114 (referred to as "C2" in FIG. 5), the third compressor 113 (referred to as "C3" in FIG. 5), and the fourth compressor 115 (referred to as "C4" in FIG. 5) are in an OFF state configured not deliver any load. The controller 128 of the first HVAC system 1000 may receive a command or respond to a triggering condition to initiate a multi-stage procedure where one or more of the compressors C1, C2, C3, or C4 will be commanded to an "ON" state for meeting an initial demand.

In some embodiments, the controller 128 may operate the refrigerant compressor assembly 100 in three demand stages—referred to here as first demand stage Y1, second demand stage Y2, and third demand stage Y3, where each stage comprises a successively higher capacity to meet an increasing demand. The third demand stage Y3 may correspond to the upper range of the full capacity of the refrigerant compressor assembly 100.

For example, the full capacity of the HVAC system 1000 may comprise 100% of total available unit capacity. The first demand stage Y1 may correspond to the lower range of capacity of the refrigerant compressor assembly 100 configured to change environmental conditions (e.g. temperature) of the controlled space. For example, the capacity of the first demand stage Y1 may comprise about 25% of total available unit capacity. The second demand stage Y2 may comprises an intermediate capacity between the Y1 capacity and the Y3 capacity, for example about 60% of total available unit capacity. It will be understood by persons of ordinary skill in the art that the range of capacity from lowest to highest may depend on the specifications of the compressors and the efficiency of the HVAC system 1000, among other factors. The operational capacity of each HVAC system 1000 may be tailored to meet the requirements of controlling the environment in the enclosed space.

The first HVAC system 1000 may be configured to transition from a least a lower demand stage to a higher demand stage, where the refrigerant compressor assembly 100 outputs a lower capacity at the lower demand stage, and a higher capacity at the higher demand stage, for example from the first demand stage Y1 to the second demand stage Y2 or from Y2 to Y3. A transition from one stage to another may comprise one or more operations configured to maintain lubricant levels in the sumps of the tandem compressors of the refrigerant compressor assembly 100 and lessen the risk of condensation of refrigerant in the sump of an idle tandem compressor.

In the first mode of operation, the transition from the lower demand stage to the higher demand stage may comprise operating at least a first tandem compressor assembly (e.g. the first compressor assembly 101) at a partial capacity with one compressor operated in an ON-state and the second compressor operated in an OFF-state followed by operating the tandem compressor assembly with both compressors in an OFF-state. The time that both compressors are in the OFF-state may be configured to allow lubricant levels (e.g. oil) to equalize between the two sumps of the first and second compressor.

In the second mode of operation, the transition from the lower demand stage to the higher demand stage may comprise operating at least both compressors of at least a first tandem compressor assembly in an OFF-state to both compressors of the first tandem compressor assembly in an ON-state. In some embodiments, the lower demand stage may comprise a configuration of the refrigerant compressor assembly where all compressors are in an OFF-state, and there is no load demand on the HVAC system 1000, e.g. the pre-demand state shown as operation 200 in FIG. 5A.

By convention, the ON-state or the OFF-state of each compressor C1, C2, C3, or C4 will be referred to here and shown in the figures (i.e. FIGS. 5, 6, 9, and 10) with the equal sign notation. For example, "C1=ON" means that the compressor C1 is running to meet a desired load, and "C1=OFF" means that the compressor C1 is not running to meet a desired load. In some embodiments, the OFF-state may include configurations where the compressor remains in a powered state, but is not delivering pressurized refrigerant to the first HVAC system 1000.

Each compressor in the ON-state may comprise a single fixed capacity, a variable capacity, or a staged capacity of two or more fixed capacities (e.g. a two-stage compressor). The selection of the capacity of each compressor in the ON-state may be adjusted to meet the desired load demand.

In operation 202 shown in FIG. 5A, the controller 128 may operate at a first demandstage capacity Y1 with at least one compressor of a tandem compressor assembly of the first HVAC system 1000 in an ON-state. For example, the first HVAC system 1000 may be operated with C1=ON and C2=OFF, corresponding to the first compressor assembly 101. At least any one of the four compressors may be in an ON-state during operation 202 to meet the demand of the first demand stage Y1. The selection of which compressor (i.e. C1, C2, C3, or C4) of the tandem compressor assembly (i.e. the first compressor assembly) to operate in the ON-state may depend on the individual capacity of each compressor in the tandem assembly and the desired load demand.

In some embodiments, both compressors C3 and C4 of the second compressor assembly 102 may remain in an OFF-state during operation 202. The capacity of the first demand stage Y1 may be configured to meet a relatively low demand that can be met by the operation of a single compressor (e.g. C1). After a certain period of time operating the first HVAC system 1000 at Y1 capacity, the controller 128 may determine that an increase in capacity is required to meet the demand on the first HVAC system 1000.

In operation 204 shown in FIG. 5A, the controller 128 may receive a signal from the thermostat 135 that the ambient temperature is near, at, or above the mode transition temperature (referred to as "MTT" in FIGS. 5 and 8). The relationship of the ambient temperature to the MTT may allow the first HVAC system 1000 to determine whether to operate the first HVAC system 1000 in the first or the second mode.

In operation 206, in response to an indication that the ambient temperature is near, at, or above the MTT, the controller 128 may operate the first HVAC system 1000 at the capacity of the second demand stage Y2 in the first mode with at least one compressor of a second compressor assembly running. The Y2 capacity may correspond to the middle range of the total operating capacity of the refrigerant compressor assembly 100, i.e. a partial load. For example, as shown in operation 206 of FIG. 5A, the controller 128 may operate the refrigerant compressor assembly 100 in a C1=ON, C2=OFF, C3=ON, and C4=OFF configuration.

Compressor C3 may be selected as the running compressor to meet the demand load of the Y2 capacity, because the compressor is on an alternate flow line circuit, which utilizes alternate heat transfer devices, i.e. condenser and evaporator. For example, referring to FIGS. 1 and 2, running the first compressor 112 (corresponding to C1 in FIG. 5) on the flow line circuit 107 in conjunction with the third compressor 113

(corresponding to C3 in FIG. 5) on the flow line circuit 109 allows the first HVAC system 1000 to utilize both portions of the condenser 104 and evaporator 108, portions 104*a*, 104*b* and 108*a*, 108*b*, respectively. Using both portions of the condenser 104 and the evaporator 108 increases the efficiency of the first HVAC system 1000 over using only one portion of each heat transfer device, because it increases the number of coils available for the transfer of thermal energy between the refrigerant and the environment. For example, if the first HVAC system 1000 were operated with C1 and C2 in an ON-state, where C1 and C2 share the same flow line circuit 107, then the first HVAC system 1000 utilizes only half of the available coils of the condenser 104 and evaporator 108, i.e. portions 104*a* and 108*a*, respectively.

In operation 206 shown in FIG. 5A, the controller 128 may determine that an increase in capacity is required to meet the demand on the first HVAC system 1000. The controller 128 may transition the output capacity from the second demand stage Y2 capacity, a partial load, to a third demand stage Y3 capacity, a full load. The Y3 capacity may require that both compressors of the tandem assemblies, e.g. C1 and C2 or C3 and C4, of the refrigerant compressor assembly 100 be operated in an ON-state. The controller 128 may initiate a transition sequence of one or more operations to minimize the risk that the OFF compressors, i.e. compressors C2 and C4 coming from operation 206, will be started with low or diluted lubricant in the respective sumps, sumps 132 and 136 shown in FIG. 2. The transition sequence may comprise turning OFF all compressors of at least one tandem compressor assembly while operating at least one alternate compressor assembly in an ON state.

In operation 208 shown in FIG. 5A, the controller 128 may operate the refrigerant compressor assembly 100 in a C1=OFF, C2=OFF, C3=ON, and C4=OFF configuration for a first transition time period. The first transition time period may be configured to allow sufficient time for lubricant to equalize between the two tandem-connected OFF compressors, i.e. C1 and C2. The first transition time period may further be configured to minimize any reduction in capacity from the refrigerant compressor assembly 100. For example, in operation 208 only one compressor C3 of the second compressor assembly 102, which is a tandem assembly, is running, which may, depending on the total available capacity of C3, result in a reduction delivered capacity by the first HVAC system 1000. In some embodiments where C3 is a variable or at least a two-speed capacity, the controller 128 may increase the delivered capacity from C3 to meet the desired load demands, and increase user comfort during the transition sequence.

In operation 209 shown in FIG. 5A, the controller 128 may operate the refrigerant compressor assembly 100 in a C1=ON, C2=ON, C3=OFF, and C4=OFF configuration for a second transition time period. The second transition time period may be configured in a similar manner as the first transition time period—allowing time for oil equalization between tandem-connected compressors and minimizing any user discomfort due to reduced delivered capacity. In some embodiments where C1 or C2 is a variable capacity or at least a two-speed capacity, the controller 128 may increase the delivered capacity from C1 and C2 to meet the desired load demands, and increase user comfort during the transition sequence.

In some embodiments, the first transition time period and the second transition time period may be about 5 (five) minutes. The transition time periods may be preset in the programming of the controller 128 or calculated by the controller 128 in an adjustable manner based on load demands, the available capacities of the refrigerant compressor assembly 100 during the respective transition operation environmental conditions, and estimations of user comfort. The first transition time period may be different from the second transition time period based on differences in the state of the first HVAC system 1000 and the environment during the two respective operations 208 and 209.

In operation 210 shown in FIG. 5A, the controller 128 may operate at a third-stage Y3 capacity with the refrigerant compressor assembly 100 in a C1=ON, C2=ON, C3=ON, and C4=ON configuration following completion of the transition sequence. The Y3 capacity may be configured to meet the highest anticipated demands on the first HVAC system 1000, and may correspond to the upper range of the total operating capacity of the refrigerant compressor assembly 100, e.g. operating all compressors in the ON-state or at or about their highest speed.

Referring to FIG. 5A, due to demands on the first HVAC system 1000, the controller 128 may change operation of the refrigerant compressor assembly 100 from the operation 200, where all compressors are in an OFF state, directly to operation 204, where the controller 128 determines whether to operate the first HVAC system 1000 in the first mode or the second mode based on ambient temperature. In other embodiments, the controller 128 may change operation of the refrigerant compressor assembly 100 from the operation 200 directly to operation 210, where the controller 128 operates the first HVAC system 1000 at the capacity of the third demand stage Y3 at or near full capacity.

Referring to FIG. 5B, in response to a decrease in demand, for example the environmental conditions are trending toward, near, or at the desired temperature profile, the controller 128 may change operation of the first HVAC system 1000 from a full load at the Y3 capacity (operation 210) to a partial load at the Y2 capacity. Following operation of the first HVAC system 1000 at Y3 capacity and in response to a decrease in demand, the controller 128, in operation 212, may receive a signal from the thermostat 135 that the ambient temperature is above the MTT. In response to an indication that the ambient temperature is above the MTT, the controller 128 may initiate operation 206, described above, to deliver a Y2 capacity.

In response to a further decrease in demand, the controller 128 may change operation of the first HVAC system 1000 from the capacity of the second demand stage Y2 (operation 206) to the Y1 capacity. The controller 128 may initiate operation 202, described above, to deliver a Y1 capacity.

Referring now to FIG. 5C, the controller 128, in either operation 204 (shown in FIG. 5A) or in operation 212 (shown in FIG. 5B), may receive a signal from the thermostat 135 that the ambient temperature is below the MTT. In response, the controller 128, in operation 216 may operate the first HVAC system 1000 at the Y2 stage capacity in a C1=OFF, C2=OFF, C3=ON, and C4=ON configuration. If the controller determines that a greater capacity is required, e.g. a Y3 capacity, then the HVAC system may be operated with all compressors ON (operation 210). By switching both compressors of each tandem assembly (e.g. C1 and C2) from an OFF-OFF configuration to an ON-ON configuration, the controller 128 avoids operating the compressors C1 and C2, in other embodiments compressors C3 and C4, in an ON-OFF configuration in the second mode of operation, and lessens the risk of condensation of oil in the sump of the idle compressor of the tandem assembly. If the controller 128 determines that a lesser capacity is required, e.g. a Y1 capacity, then the first HVAC system 1000 may be operated with C1=ON and the remainder of compressors OFF (operation 202).

Second HVAC System 1002

Figure 6:
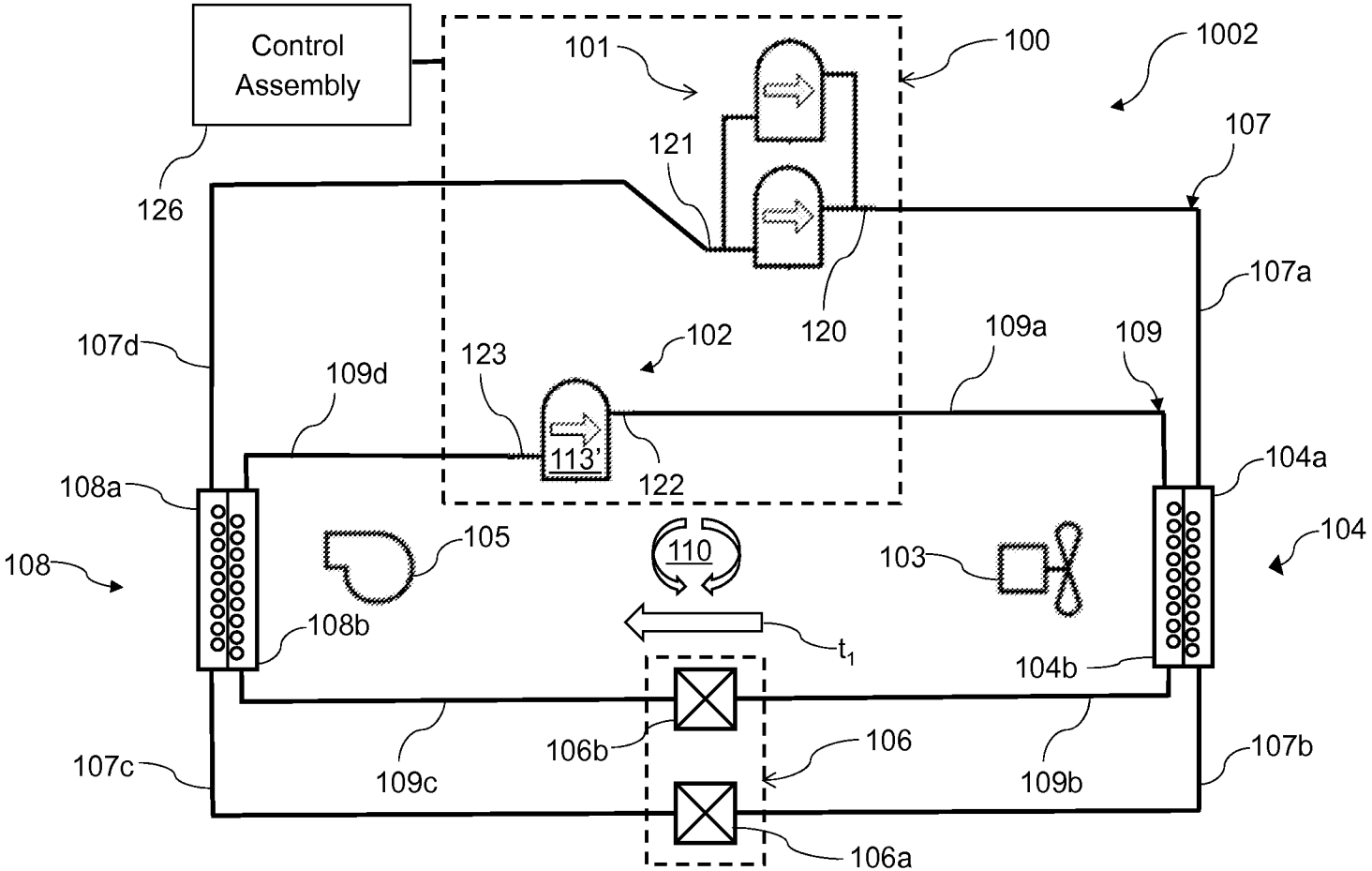
FIG. 6 illustrates a second HVAC system having a first and second compressor assembly.
Figure 7:
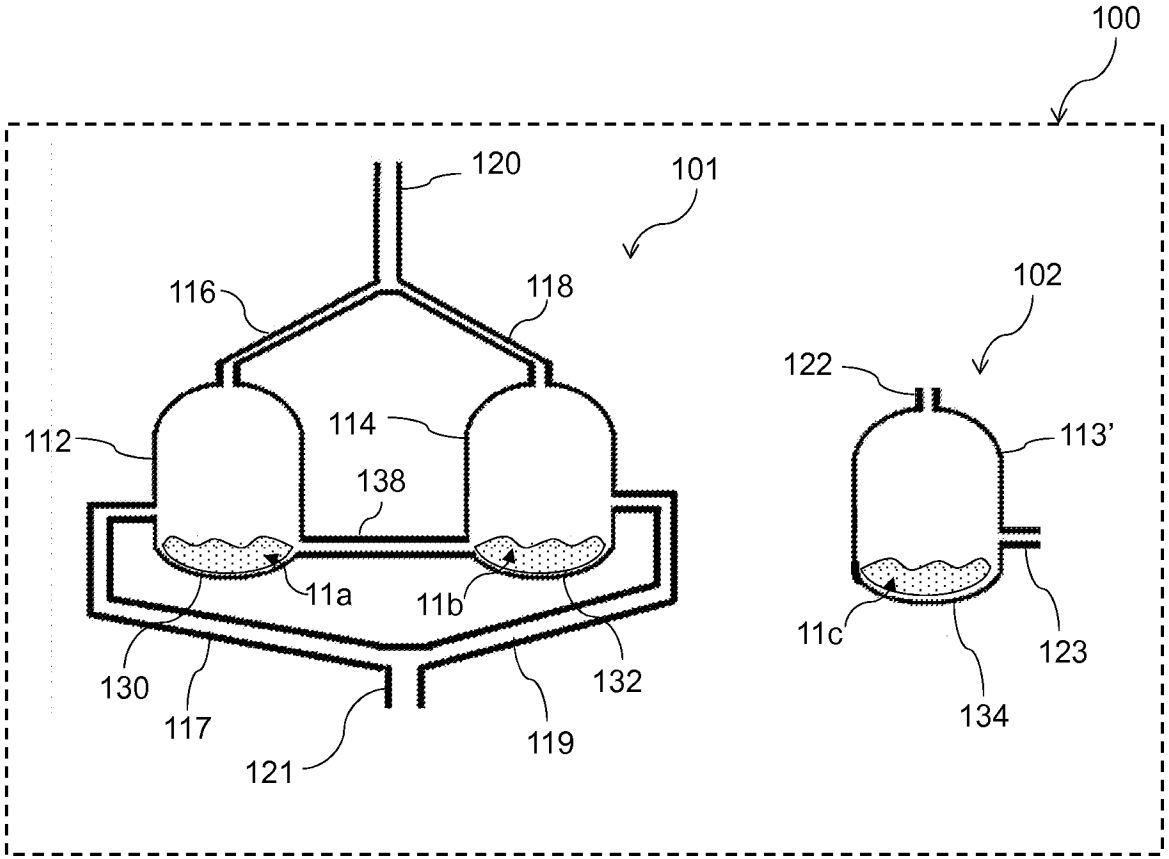
FIG. 7 shows a schematic of the first and second compressor assembly illustrated in FIG. 6.

In other embodiments, as shown in FIGS. 6 and 7, the second compressor assembly 102 of a second HVAC system 1002 may comprise a single two-speed compressor, referred to as the third compressor 113', operated in conjunction with the first compressor assembly 101, a tandem compressor assembly. Except where as noted, the second HVAC system 1002 may include substantially similar or the same components as the first HVAC system 1000, described in FIGS. 1-4, including, but not limited to, the control assembly 126 and controller 128, described herein and shown in FIGS. 1, 3, and 6. Components of the second HVAC system 1002 that are substantially similar or the same will be referenced using the same reference numerals as those shown in FIGS. 1-4 for the first HVAC system 1000.

Referring to FIGS. 6 and 7, the third compressor 113' may comprise the suction line 123 and the discharge line 122. These lines 123, 122 are tied into second condenser portion 104*b* and second evaporator portion 108*b* of the flow line circuit 109 (shown in the segments 109*a-d*), which is a separate circuit from the flow line circuit 107, as described above in regard to FIGS. 1 and 2. The third compressor 113' may also comprise a sump 134, which does not share lubricant with the other compressors 112, 114

Second Method 3000 for Managing Lubricant Levels in an HVAC System

Referring to FIGS. 8A, 8B, 8C, and 8D (referred to collectively as "FIG. 8"), a second method 3000 for managing lubricant levels of a tandem compressor assembly in an HVAC system may comprise the second HVAC system 1002 of FIGS. 6 and 7. The second HVAC system 1002 may be configured to respond to measurement of an ambient temperature at or below the mode transition temperature ("MTT"), for example by use of temperature data from the temperature detecting assembly 129 and thermostat 135, as shown and described in FIGS. 3 and 4.

The second HVAC system 1002 may be configured to operate in one or more modes based on the effect of ambient temperature on the sump superheat of an idle compressor. At temperatures above the MTT, the HVAC system 1002 may be operated in a third mode with the objective of maximizing efficiency. The third mode of the second method 3000 may include similar operations to the first mode of the first method 2000 (described in FIG. 5). For example, the tandem compressor assembly (i.e. the first compressor assembly 101 shown in FIGS. 6 and 7) may be operated with one compressor ON and the other OFF, when there is only a partial load demanded on the HVAC system 1002. When transitioning from a partial load to a full load in the first mode of operation, all compressors in the tandem compressor assembly may be turned to an OFF-state to allow time for oil to equalize between the sumps of the tandem-connected compressors, before the compressors are resumed to at or near full capacity. An alternate compressor assembly may deliver an output load from the second HVAC system 1002 during the transition time period of the third mode.

At temperatures below the MTT, the second HVAC system 1002 may be operated in a fourth mode with the objective of extending compressor life, i.e. maximizing reliability. The fourth mode of the second method 3000 may include similar operations to the second mode of the first method 2000 (described in FIG. 5). For example, under partial loads in a lower demand stage, the load demand may be switched—turning OFF the compressors of the tandem compressor assembly—to the alternate compressor assembly (i.e. the second compressor assembly 102) to avoid operating tandem compressor system (i.e. the first compressor assembly 101 shown in FIGS. 6 and 7) of the refrigerant compressor assembly 100 with one compressor in an ON-state and the other in an OFF-state. When the second HVAC system 1002 transitions to a subsequent higher demand stage, e.g. to full capacity, the OFF compressors of the tandem assembly may be jointly switched ON.

Figure 8A:
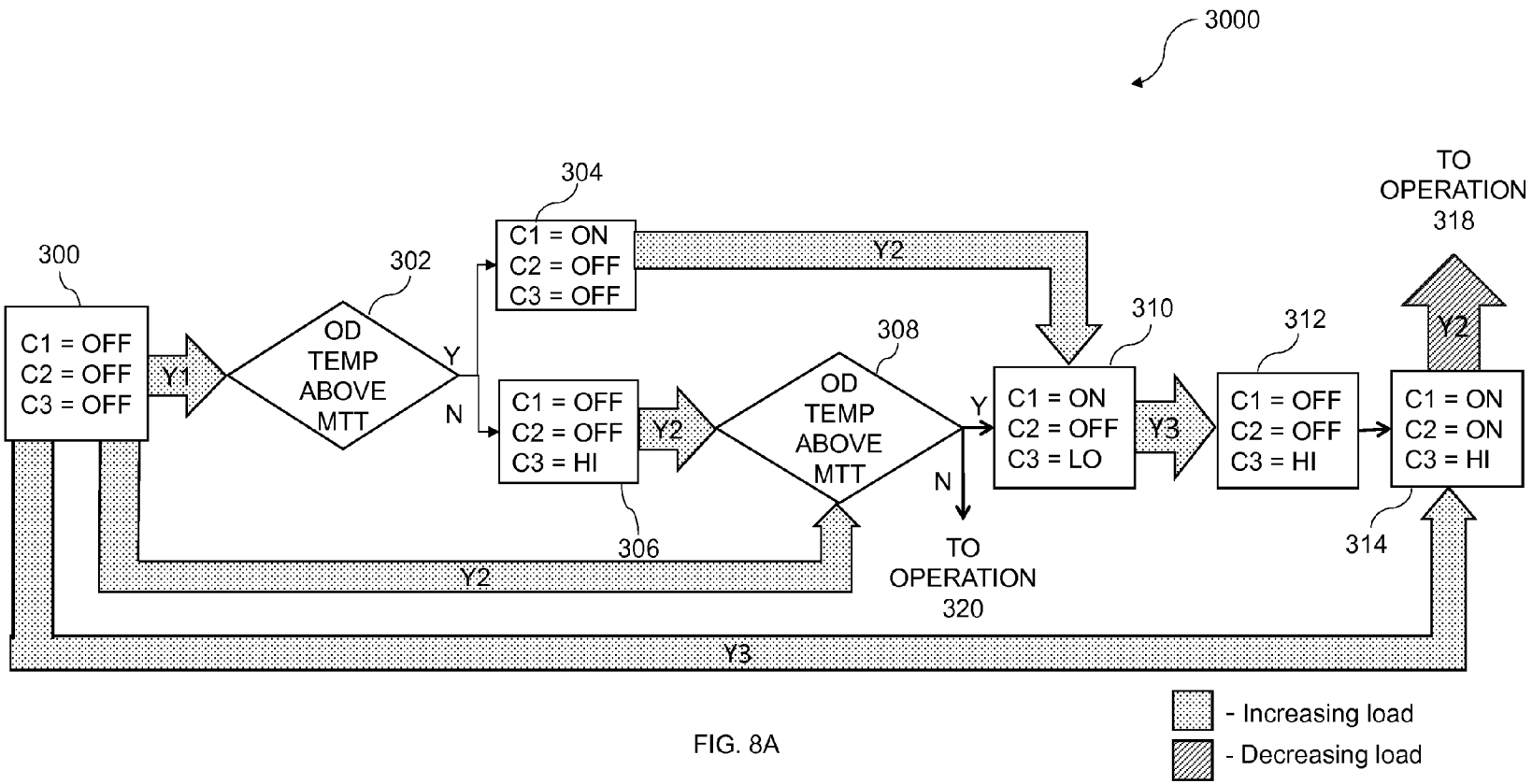
FIGS. 8A, 8B, 8C, and 8D show a flow chart of operations of a second method for managing lubricant levels in a multi-compressor assembly of an HVAC system.

In operation 300 of the second method 3000 shown in FIG. 8A, the second HVAC system 1002 may comprise a pre-demand state, where the first compressor 112 (referred to as "C1" in FIG. 8), the second compressor 114 (referred to as "C2" in FIG. 8), and the third compressor 113' (referred to as "C3" in FIG. 8) are in an OFF-state configured not deliver any load.

The controller 128 of the second HVAC system 1002 may receive a command or respond to a triggering condition to initiate a multi-stage procedure where one or more of the compressors C1, C2, or C3 will be commanded to an ON-state for meeting an initial demand. As previously described for method 2000, the multi-stage procedure may comprise a first-stage Y1 capacity corresponding to the lower range of the total operating capacity of the refrigerant compressor assembly 100, a second-stage Y2 capacity corresponding to the middle range of available capacity, and a third-stage Y3 capacity corresponding to the upper range, including full load, of capacity available to the refrigerant compressor assembly 100. In some embodiments, the pre-demand state of operation 300 may comprise a lower demand stage relative to higher demand stages Y1, Y2, and Y3.

In operation 302 shown in FIG. 8A, the controller 128 may receive a signal from the thermostat 135 that the ambient temperature is near, at, or above the MTT. The relation of the ambient temperature to the MTT may allow the second HVAC system 1002 to determine whether to operate the second HVAC system 1002 in the third or the fourth mode.

In operation 304 shown in FIG. 8A, in response to an indication that the outside ambient temperature is at or above the MTT, the controller 128 may operate at a first-stage capacity Y1 in the third mode with at least one compressor of a tandem compressor assembly of the second HVAC system 1002 in an ON state. For example, the second HVAC system 1002 may be operated with C1=ON and C2=OFF. Compressor C3 of the second compressor assembly 102 may remain OFF during operation 304.

After operating the second HVAC system 1002 at Y1 capacity, the controller 128 may determine that an increase in capacity is required to meet the demand on the second HVAC system 1002. From operation 304, the controller 128 may operate the second HVAC system 1002 at a second-stage capacity Y2 in the third mode with at least one compressor of the first compressor assembly 101 (e.g. C1) running. As shown in FIG. 8A, the third compressor 113' of the second compressor assembly 102, which may be a two-stage compressor, may be operated at its lower speed (referred to as "LO" in FIG. 8) to meet the intermediate demand loads of the Y2 capacity.

Alternatively, in operation 306, in response to an indication that the outside ambient temperature is below the MTT, the controller 128 may operate at a first-stage capacity Y1 in the fourth mode with both compressors of the tandem compressor assembly of the HVAC system 1002 in an OFF state. For example, the second HVAC system 1002 may be operated with C1=OFF and C2=OFF. Compressor C3 of the second compressor assembly 102 may be operated at the HI speed setting.

In operation 308 shown in FIG. 8A, the controller 128 may receive a signal from the thermostat 135 that the ambient temperature is near, at, or above the MTT, which provides further indication whether the HVAC system 1002 should be operated in the third or fourth mode. In response to an indication that the ambient temperature is near, at, or above the MTT, the controller 128 may operate the second HVAC system 1002 according to operation 310, described above, following operation 308.

In some embodiments, where load demand is in the lower range of the Y2 capacity, the third compressor 113' may be turned OFF. It may be advantageous in operation 310 to operate the third compressor 113' at least at its LO speed in conjunction with compressor C1 so that both available sets of coils from each portion of the condenser 104 and the evaporator 108 are utilized in the heat transfer cycle 110. Operation of the second HVAC system 1002 in this manner may result in shorter operation times and save on energy costs, under some circumstances.

After operating the second HVAC system 1002 at the Y2 capacity in operation 310, the controller 128 may determine that an increase in capacity is required to meet the demand on the second HVAC system 1002. The controller 128 may transition the output capacity to the third demand stage Y3 capacity, a full load. The Y3 capacity may require that both compressors of the tandem assembly, e.g. C1 and C2, of the refrigerant compressor assembly 100 be operated in an ON-state. In operation 312, the controller 128 may initiate a transition sequence of one or more operations to minimize the risk that the OFF compressors, i.e. compressor C2, coming from operation 310, will be started with low or diluted lubricant in the respective sumps 130, 132 shown in FIG. 7. The transition sequence may comprise turning OFF all compressors of at least one tandem compressor assembly while operating at least one alternate compressor assembly in an ON state.

In operation 312 shown in FIG. 8A, the controller 128 may operate the refrigerant compressor assembly 100 in a C1=OFF, C2=OFF, C3=HI configuration in the third mode for a third transition time period. The third transition time period may be configured to allow sufficient time for lubricant to equalize between the two tandem-connected OFF compressors, i.e. C1 and C2. In a manner similar to the first and second transition time periods discussed above and in FIG. 5, the third transition time period may further be configured to minimize any reduction in capacity from the refrigerant compressor assembly 100. During the third transition time period, the compressor C3 (i.e. the third compressor 113' shown in FIGS. 6 and 7) may be operated at its high speed (referred to as "HI" in FIG. 8) to meet load demands, and to reduce any user discomfort due to reduced capacity.

In some embodiments, the third transition time period is about five minutes. The third transition time period may be preset in the programming of the controller 128 or calculated by the controller 128 in an adjustable manner based on load demands, environmental conditions, and estimations of user comfort.

In operation 314 shown in FIG. 8A, the controller 128 may operate the second HVAC system 1002 at a third demand stage Y3 with the refrigerant compressor assembly 100 in a C1=ON, C2=ON, and C3=HI configuration following completion of the transition sequence. As shown in FIG. 8A, the third compressor 113' of the second compressor assembly 102 may be operated at about its highest speed to meet the full demand loads of the Y3 capacity.

Referring to FIG. 8A, due to demands on the second HVAC system 1002, the controller 128 may change operation of the refrigerant compressor assembly 100 from the operation 300, where all compressors are in an OFF-state, directly to operation 308, where the controller 128 determines whether to operate the second HVAC system 1002 in the first mode or the second mode based on ambient temperature. In other embodiments, the controller 128 may change operation of the refrigerant compressor assembly 100 from the operation 300 directly to operation 314, where the controller 128 operates the second HVAC system 1002 at the third-stage Y3 capacity at or near full capacity.

After operating the second HVAC system 1002 at Y3 capacity (for example in operation 314 shown in FIG. 8A), the controller 128 may determine that a decrease in capacity may meet a lower demand on the second HVAC system 1002, for example, because the temperature or other environmental conditions in the enclosed space is trending towards the desired temperature profile. In operation 318 shown in FIG. 8C, the controller 128 may receive a signal from the thermostat 135 that the ambient temperature is near, at, or above the MTT, which provides further indication whether the second HVAC system 1002 should be operated in the third or fourth mode.

Figure 8B:
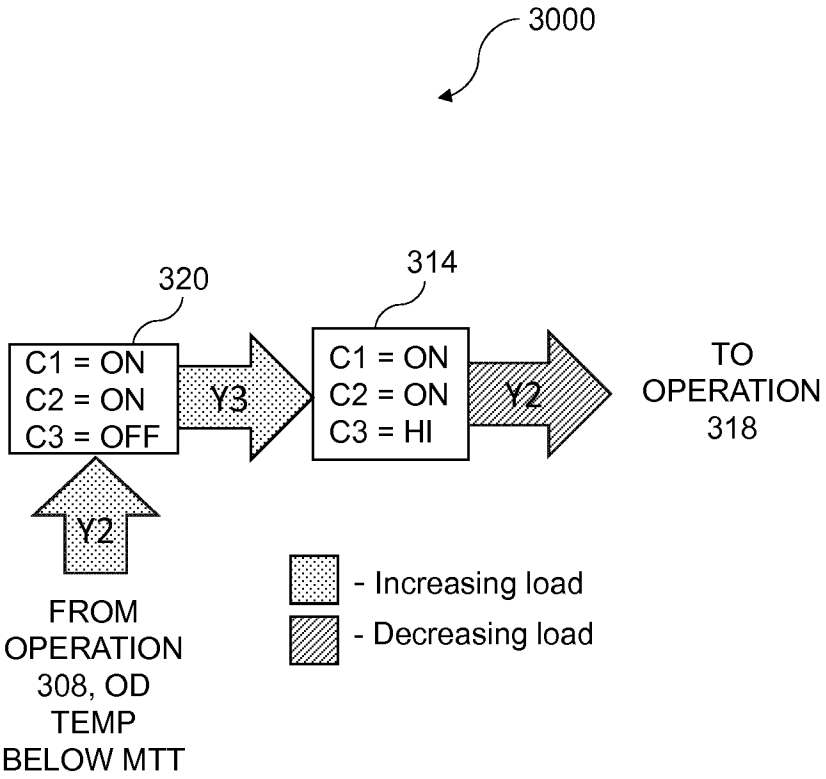
Figure 8C:
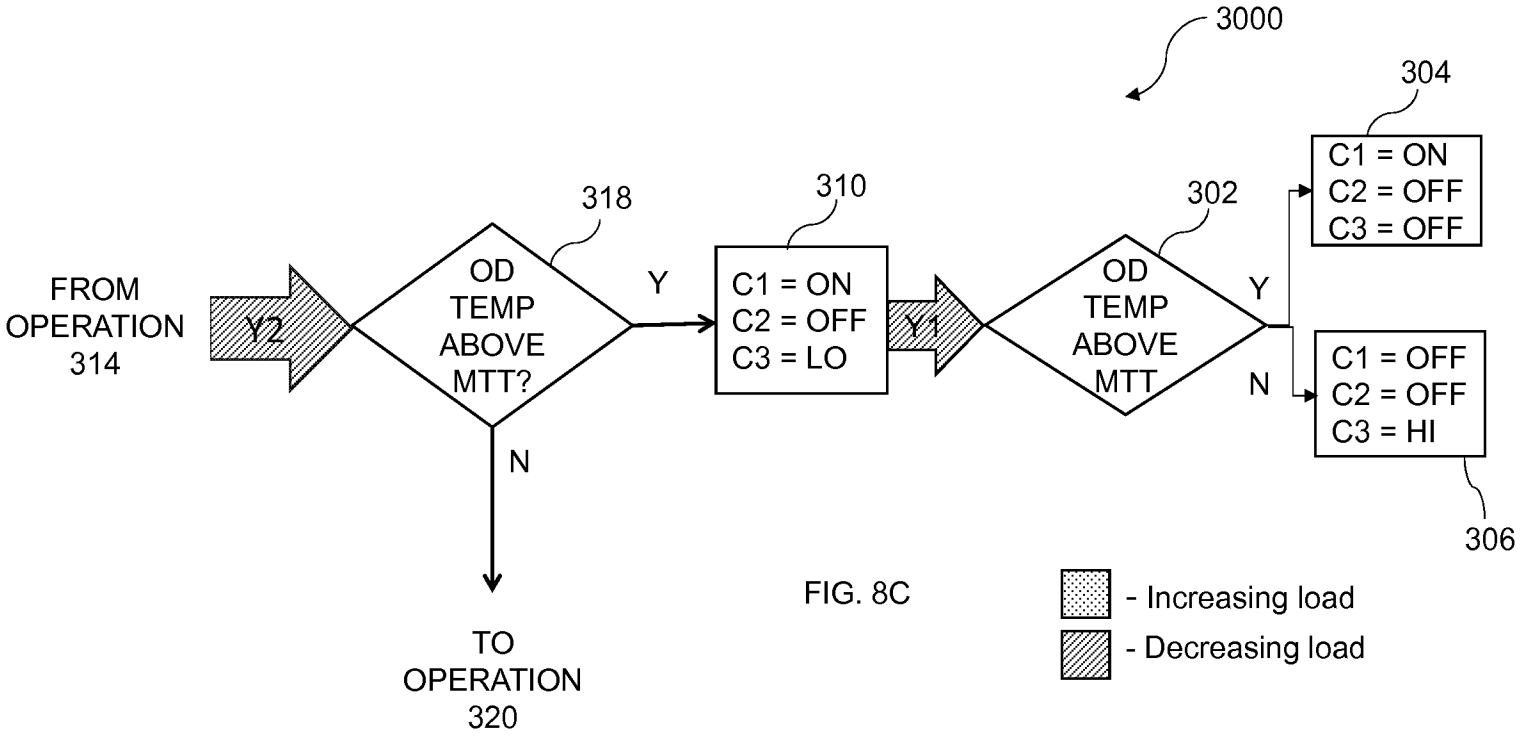

In operation 310 shown in FIG. 8C, in response to an indication that the ambient temperature is near, at, or above the MTT, the controller 128 may operate the second HVAC system 1002 at a second-stage capacity Y2 in the third mode with at least one compressor of the first compressor assembly 101 (e.g. C1=ON and C2=OFF) running. The compressor C3 (third compressor 113') may be operated at its LO speed setting.

After operating the second HVAC system 1002 at the Y2 capacity, the controller 128 may determine that a lower capacity, e.g. Y1 capacity, may meet the load demand. In operation 304 shown in FIG. 8C, in response to an indication that the ambient temperature is near, at, or above the MTT (operation 302), the controller 128 may operate the second HVAC system 1002 at the Y1 capacity according to the third mode, described previously. Alternatively, in operation 306, in response to an indication that the ambient temperature is below the MTT (operation 302), the controller 128 may operate the second HVAC system 1002 at the Y1 capacity according to the fourth mode, described previously.

Referring now to FIG. 8B, the controller 128, in operation 308 (shown in FIG. 8A), may receive a signal from the thermostat 135 that the ambient temperature is below the MTT. In response, the controller 128 in operation 320 may operate the second HVAC system 1002 at a second demand stage Y2 capacity with the refrigerant compressor assembly 100 in a C1=ON, C2=ON, and C3=OFF configuration following completion of the transition sequence.

If in operation 320 shown in FIG. 8B, the controller 128 determines that a greater capacity is required, e.g. a Y3 capacity, then the second HVAC system 1002 may be operated with all compressors ON (operation 314). The third compressor 113' (C3 in FIG. 8B) may be operated at its HI speed setting to meet the required load demand.

Figure 8D:
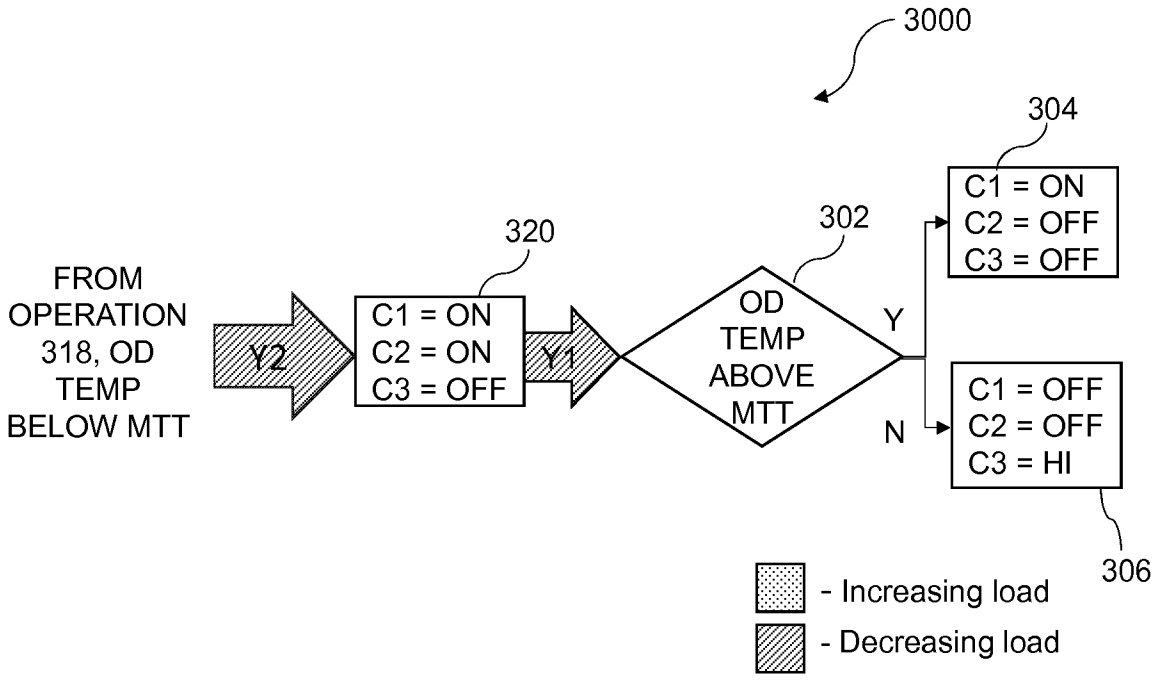

Referring to FIG. 8D, in response to a decrease in demand, for example the environmental conditions are trending toward, near, or at the desired temperature profile from the operation 314 referred to in FIG. 8C, the controller 128 may change operation of the second HVAC system 1002 from a full load at Y3 capacity (operation 314) to a partial load at Y2 capacity. The controller 128, in operation 318, may receive a signal from the thermostat 135 that the ambient temperature is below the MTT. In response to an indication that the ambient temperature is below the MTT, the controller 128 may initiate operation 320, described above, to deliver a Y2 capacity. As the load demand decreases to the range of the Y1 capacity, the controller 128 may receive a signal from the thermostat 135 that the ambient temperature is near, at, or above the MTT (operation 302 shown in FIG. 8D). If so, the controller 128 may operate the second HVAC system 1002 according to operation 304, described above, in a C1=ON, C2=OFF, and C3=OFF configuration. If not, the controller 128 may operate the second HVAC system 1002 according to operation 306, described above, in a C1=OFF, C2=OFF, and C3=HI configuration.

It will be understood by persons of ordinary skill in the art that the controller 128 may determine during any operation that demand on the HVAC systems 1000 and 1002 has been satisfied (for example, the desired temperature profile has been achieved in the enclosed space) and may perform operations to decrease capacity, e.g. demand stages Y3 to Y2 to Y1, and subsequently turn OFF all compressors. In other embodiments, the controller 128 may change the operation of all compressors to an OFF state, as shown in operations 200 and 300, without further transition to lower capacity stages.

It will be understood by persons of ordinary skill in the art that the controller 128 may comprise one or more processors and other well-known components. The controller 128 may further comprise two or more components operationally connected but located in separate in locations in the HVAC systems 1000 and 1002, including operationally connected by wireless communications. For example, the controller 128 may comprise a first controller unit located on an outside portion of the HVAC system (where the compressor and condenser may be), a second controller unit located on an inside portion (where the evaporator may be), a thermostat for monitoring environmental conditions (on a wall of an enclosed space), and a control unit accessible for user input (embodied on a hand-held wireless unit). The controller 128 may further comprise a timing function for measuring the time periods disclosed herein.

Two Stage and Four Stage Systems

HVAC systems utilizing multiple demand stages may be operated under the same or similar methods for managing lubricant levels of a tandem compressor assembly as the three stage system discussed above in FIGS. 1-8. Referring to FIGS. 9A and 9B, there is shown in a table format, by example, compressor switching operations for compressors in a dual tandem system having two demand stages—Y1, a lower demand stage, and Y2, a higher demand stage. FIGS. 9C and 9D, show by example compressor switching operations of a dual tandem system having four demand stages—Y1, Y2, Y3, and Y4 each successively comprising a higher capacity to meet an increasing load demand. In some embodiments, tandem assembly 1 and tandem assembly 2 referenced in FIGS. 9A-9D may comprise the first compressor assembly 101 and the second compressor assembly 102 of the first HVAC system 1000 shown in FIGS. 1 and 2.

Referring to FIG. 9A, in the first mode of operation, the controller 128 (shown in FIG. 3) may transition the refrigerant compressor assembly 100 from the first demand stage Y1 (i.e. the lower demand stage) to the second demand stage Y2 (i.e. the higher demand stage). In transition operation $T_1$, the controller 128 may operate the refrigerant compressor assembly 100 in a C1=OFF, C2=OFF, C3=ON, and C4=OFF configuration for the first transition time period in a manner the same or similar to operation 208 in FIG. 5A. In transition operation T2, the controller 128 may operate the refrigerant compressor assembly 100 in a C1=ON, C2=ON, C3=OFF, and C4=OFF configuration for the second transition time period in a manner similar to the operation 209 of FIG. 5A.

Referring to FIG. 9C, similar transitions operations $T_1$ and $T_2$ may be utilized in a four stage system. For example, transition operation $T_1$ may be utilized between the second demand stage Y2 and the third demand stage Y3, and transition operation may be utilized between the third demand stage Y3 and the fourth demand stage Y4.

Referring to FIG. 9B, in the second mode of operation, the controller 128 (shown in FIG. 3) may transition the refrigerant compressor assembly 100 from the pre-demand state Y0 to the first demand stage Y1 and to the second demand stage Y2. In some embodiments, the lower demand stage may include the pre-demand state (e.g. operation 300 in FIG. 8A) where all compressors are in an OFF-state. In the first demand stage Y1, the controller 128 may operate the first HVAC system 1000 in a C1=ON, C2=ON, C3=OFF, and C4=OFF configuration to transition from the pre-demand stage Y0 to the first demand stage Y1. In the second demand stage Y2, the controller 128 may operate the first HVAC system 1000 in a C1=ON, C2=ON, C3=ON, and C4=ON configuration.

By switching both compressors of each tandem assembly 1 and 2 in FIG. 9B from an OFF-OFF configuration to an ON-ON configuration and avoiding a ON-OFF configuration in the second mode of operation, the refrigerant compressor assembly 100 is operated in a manner similar to operation 216 in FIG. 5C. Similar compressor switching operations may be utilized in the four stage system represented in FIG. 9D. For example, compressors C3 and C4 are operated in the OFF-OFF configuration in the first demand stage Y1 and transitioned to the ON-ON configuration in the second demand stage Y2. Compressors C1 and C2 are operated in the OFF-OFF configuration in the second demand stage Y2 and transitioned to the ON-ON configuration in the third demand stage Y3. In the lower demand stage, e.g. Y2 relative to the higher demand stage Y3, the load demand may be switched—turning OFF the compressors of the tandem assembly 1—to the alternate tandem assembly 2.

Referring to FIGS. 10A and 10B, there is shown in a table format, by example, compressor switching operations for compressors (referred to as C1 and C2) in a tandem assembly 1 operated in conjunction with a two-speed single compressor (referred to as C3), where the compressor assembly operates in two demand stages—Y1, a lower demand stage, and Y2, a higher demand stage. FIGS. 10C and 10D, show by example compressor switching operations of a tandem assembly 1 operated in conjunction with a two-speed single compressor having four demand stages—Y1, Y2, Y3, and Y4, each stage having a successively higher capacity to meet a higher demand. In some embodiments, tandem assembly 1 and the 2-speed compressor referenced in tables of FIGS. 10A-10D may comprise the first compressor assembly 101 and the second compressor assembly 102 of the second HVAC system 1002 shown in FIGS. 6 and 7.

The two-stage system referred to in FIG. 10A and the four-stage system referred to in FIG. 10C may include the same or similar transition operations from a lower demand stage, where tandem compressors are operated in an ON-OFF state to a higher demand stage, where both tandem compressors are operated in an ON-state, as those disclosed for operation of the three stage system in the first mode, shown in FIG. 8. For example, in transition operation $T_3$ shown in FIG. 10A, the controller 128 transitioning the second HVAC system 1002 from demand stages Y1 to Y2 may operate the refrigerant compressor assembly 100 in a C1=OFF, C2=OFF, C3=HIGH configuration for the third transition time period in a manner the same or similar to operation 312 in FIG. 8A. In the transition operation $T_3$ shown in FIG. 10C, the controller 128 transitioning the second HVAC system 1002 from the third demand stage Y3 to the fourth demand stage Y4 may operate the refrigerant compressor assembly 100 in a C1=OFF, C2=OFF, C3=HIGH configuration for the third transition time period in the same or a similar manner to operation 312 in FIG. 8A. In the higher demand stage, i.e. demand stage Y2 in FIG. 10A and demand stage Y4 in FIG. 10C, both compressors of the tandem assembly 1 are operated in the ON-state.

The two-stage system referred to in FIG. 10B and the four-stage system referred to in FIG. 10D may include the same or similar transition operations from a lower demand stage, where the compressors of the tandem assembly 1 are operated in an OFF-OFF state to a higher demand stage, where both tandem compressors are operated in an ON-state, as those disclosed for operation of the three stage system in the second mode, shown in FIG. 8. For example as shown in FIG. 10B, the controller 128 may operate the second HVAC system 1002 in a C1=ON, C2=ON, C3=OFF configuration to transition from the pre-demand state Y0, where both tandem compressors C1 and C2 are in an OFF-state to the first demand stage Y1. As shown in FIG. 10D, tandem compressors C1 and C2 are operated in the OFF-OFF configuration in the second demand stage Y2 and transitioned to the ON-ON configuration in the third demand stage Y3. The speed of the 2-speed compressor C3, as an alternate compressor assembly, may be adjusted in the first, second, third and fourth demand stages Y1, Y2, Y3, Y4 of the two-stage and four stage system to meet the desired capacity during the transitions between stages.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A control system for a heating, ventilation, and air conditioning (HVAC) system, the control system comprising:

a control assembly configured to operationally connect to an HVAC compressor assembly of an HVAC system for controlling the environment in an enclosed space;

wherein the control assembly comprises a controller configured to control operation of a first compressor assembly and a second compressor assembly of the HVAC compressor assembly;

wherein the HVAC compressor assembly is configured for operation by the controller to deliver a load capacity in one or more demand stages, wherein the controller operates the HVAC compressor assembly in at least a lower demand stage and a higher demand stage, wherein the HVAC compressor assembly delivers a larger capacity at the higher demand stage than at the lower demand stage;

wherein the HVAC compressor assembly is configured for operation by the control assembly in one or more modes of operation based on an ambient temperature outside the enclosed space;

wherein the first compressor assembly comprises a first tandem compressor assembly having a first compressor and a second compressor operationally connected for tandem operation as part of a first circuit having first heat transfer devices;

wherein the second compressor assembly comprises at least a third compressor comprising a part of a second circuit having second heat transfer devices separated from the first heat transfer devices;

wherein, in a first mode of operation, the controller is configured to operate the first compressor in an ON-state and the second compressor in an OFF-state during the lower demand stage;

wherein, in response to an increase in load demand on the HVAC compressor assembly from the lower demand stage to the higher demand stage, the controller is configured to operate the first compressor in an OFF-state and the second compressor in an OFF-state to keep the first compressor and the second compressor idle for a first time period, and wherein the first time period allows lubricant levels to equalize between the first compressor and the second compressor;

wherein during the first time period, the controller operates the third compressor in an ON-state to utilize the heat transfer capacity of the second heat transfer devices on the second circuit; and following expiration of the first time period, the first compressor and the second compressor are operated in an ON-state in the higher demand stage to meet the increased load demand.

2. The control system of claim 1, wherein the load demand on the HVAC compressor assembly in the higher demand stage is a full load and following the expiration of the first time period, the controller is configured to operate the HVAC compressor assembly at the full capacity of the HVAC compressor assembly in the higher demand stage.

3. The control system of claim 1, wherein the control assembly is configured to operate the HVAC compressor assembly in the first mode or at least a second mode based on an ambient temperature measured outside the enclosed space;

wherein in response to measurement of the ambient temperature at or above a mode transition temperature ("MTT"), the controller is configured to operate the HVAC compressor assembly in the first mode, and in response to measurement of the ambient temperature below the MTT, the controller is configured to operate the HVAC compressor assembly in the second mode; and wherein the MTT is selected based on the ambient temperature at which a sump superheat of the HVAC system operating in the lower demand stage is at or above about 20 degrees Fahrenheit.

4. The control system of claim 3, wherein the MTT comprises about 65 degrees Fahrenheit.

5. The control system of claim 3, wherein, in the second mode of operation, the controller is configured to operate the first compressor in an OFF-state and the second compressor in an OFF-state in the lower demand stage;

wherein, in response to an increase in load demand on the HVAC compressor assembly from the lower demand stage to the higher demand stage, the controller is configured to operate the first compressor in an ON-state and the second compressor in an ON-state in the higher demand stage; and wherein, in the lower demand stage, the controller is configured to operate the third compressor in an ON-state.

6. The control system of claim 3, wherein in response to a decrease in load demand on the HVAC compressor assembly from the higher demand stage to the lower demand stage, the controller is configured to operate the first compressor in an ON-state and the second compressor in an OFF-state in the first mode of operation, and wherein the controller is configured to operate the third compressor in an ON-state to utilize the heat transfer capacity of the second heat transfer devices on the second circuit in conjunction with the heat transfer capacity of the first heat transfer devices on the first circuit.

7. The control system of claim 6, wherein the second compressor assembly further comprises a second tandem compressor assembly having the third compressor and a fourth compressor operationally connected for tandem operation as part of the second circuit;

wherein, in the first mode of operation, the controller operates the first compressor in an ON-state, the second compressor in an OFF-state, the third compressor in an ON-state, and the fourth compressor in an OFF-state during the lower demand stage;

wherein, in response to an increase in load demand on the HVAC compressor assembly from the lower demand stage to the higher demand stage, the controller is configured to operate the first compressor in an OFF-state and the second compressor in an OFF-state to keep the first compressor and the second compressor idle for the first time period;

wherein during the first time period, the controller is configured to operate the third compressor in an ON-state and the fourth compressor in the OFF-state to utilize the heat transfer capacity of the second heat transfer devices on the second circuit;

following expiration of the first time period, the controller is configured to operate the third compressor in an OFF-state and the fourth compressor in an OFF-state to keep the third compressor and the fourth compressor idle for a second time period and, and wherein the second time period allows lubricant levels to equalize between the third compressor and the fourth compressor;

wherein during the second time period, the controller is configured to operate the first compressor in an ON-state and the second compressor in an ON-state; and following expiration of the second time period, the controller is configured to operate the first compressor, the second compressor, the third compressor, and the fourth compressor in an ON-state in the higher demand stage to meet the increased load demand.

8. The control system of claim 7, wherein, in the second mode of operation, the controller is configured to operate the first compressor in an OFF-state, the second compressor in an OFF-state, the third compressor in an ON-state, and the fourth compressor in an ON-state during the lower demand stage; and wherein, in response to an increase in load demand on the HVAC compressor assembly from the lower demand stage to the higher demand stage, the controller is configured to operate the first compressor, the second compressor, the third compressor, and the fourth compressor in an ON-state in the higher demand stage to meet the increased load demand.

9. The control system of claim 8, wherein in response to a decrease in load demand on the HVAC compressor assembly from the higher demand stage to the lower demand stage, the controller is configured to operate the first compressor in an OFF-state, the second compressor in an OFF-state, the third compressor in an ON-state, and the fourth compressor in an ON-state during the lower demand stage in the second mode of operation.

10. The control system of claim 6, wherein the HVAC compressor assembly is further configured to operate in at least a first demand stage, a second demand stage, and a third demand stage, wherein the second demand stage and the third demand stage correspond to the lower demand stage and the higher demand stage, respectively, and the first demand stage comprises a lesser capacity than the second demand stage;

wherein the third compressor comprises a two-speed compressor having a low speed setting and a high speed setting; and wherein operation of the HVAC compressor assembly during the first demand stage by the controller is selected from the following:

1) in the first mode, operating the first compressor in an ON-state, the second compressor in an OFF-state, and the third compressor in an OFF-state; and 2) in the second mode, operating the first compressor in an OFF-state, the second compressor in an OFF-state, and the third compressor at the high setting.

11. The control system of claim 10, wherein, in the first mode of operation:

in response to an increase in load demand on the HVAC compressor assembly from the first demand stage to the second demand stage, the controller is configured to operate the first compressor in an ON-state, the second compressor in an OFF-state and the third compressor at the low setting; and in response to an increase in load demand on the HVAC compressor assembly from the second demand stage to the third demand stage, the controller is configured to operate the first compressor in an OFF-state and the second compressor in an OFF-state to keep the first compressor and the second compressor idle for the first time period;

during the first time period, the controller is configured to operate the third compressor at the high setting; and following expiration of the first time period, the controller is configured to operate the first compressor and the second compressor in an ON-state and the third compressor at the high setting in the third demand stage to meet the increased load demand.

12. The control system of claim 10, wherein, in the second mode of operation:

in response to increase in load demand on the HVAC compressor assembly from the first demand stage to the second demand stage, operation of the HVAC compressor assembly during the second demand stage by the controller is selected from the following:

1) if the HVAC compressor assembly is operated during the first demand stage in the first mode of operation, the controller is configured to operate the first compressor in an ON-state, the second compressor in an OFF-state, and the third compressor at the low setting and 2) if the HVAC compressor assembly is operated during the first demand stage in the second mode of operation with the first compressor in an OFF-state, the second compressor in an OFF-state, and the third compressor at the high setting, the controller is configured to operate the first compressor in an ON-state, the second compressor in an ON-state, and the third compressor in an OFF-state in the second demand stage to meet the increased load demand; and in response to an increase in load demand on the HVAC compressor assembly from the second demand stage to the third demand stage, the controller is configured to operate the first compressor and the second compressor in an ON-state and the third compressor at the high setting in the third demand stage to meet the increased load demand.

13. The control system of claim 12, further comprising:

wherein in response to an increase in load demand on the HVAC compressor assembly from the second demand stage to the third demand stage in the first mode of operation, the controller is configured to operate the first compressor in an OFF-state and the second compressor in an OFF-state to keep the first compressor and the second compressor idle for a third time period, wherein during the third time period, the controller is configured to operate the third compressor at the high setting, and wherein the third time period allows lubricant levels to equalize between the first compressor and the second compressor; and following expiration of the third time period, the controller is configured to operate the first compressor and the second compressor in an ON-state and the third compressor at the high setting in the third demand stage to meet the increased load demand.

14. The control system of claim 13, further comprising the following:

in response to a decrease in load demand on the HVAC compressor assembly from the third demand stage to the second demand stage, operation of the HVAC compressor assembly during the second demand stage by the controller is selected from the following:

1) in the first mode of operation, the controller is configured to operate the first compressor in an ON-state and the second compressor in an OFF-state and the third compressor at the low setting in the second demand stage to meet the decreased load demand; and 2) in the second mode of operation, the controller is configured to operate the first compressor in an ON-state, the second compressor in an ON-state, and the third compressor in an OFF-state in the second demand stage to meet the decreased load demand.

15. A method for managing lubricant levels in a tandem compressor assembly of a heating, ventilation, and air conditioning (HVAC) system, the control system comprising:

providing a control assembly configured to operationally connect to an HVAC compressor assembly of an HVAC system for controlling the environment in an enclosed space;

wherein the control assembly comprises a controller configured to control operation of a first compressor assembly and a second compressor assembly of the HVAC compressor assembly;

wherein the HVAC compressor assembly is configured for operation by the controller to deliver a load capacity in one or more demand stages, wherein the controller operates the HVAC compressor assembly in at least a lower demand stage and a higher demand stage, wherein the HVAC compressor assembly delivers a larger capacity at the higher demand stage than at the lower demand stage;

wherein the HVAC compressor assembly is configured for operation by the control assembly in one or more modes of operation based on an ambient temperature outside the enclosed space;

wherein the first compressor assembly comprises a first tandem compressor assembly having a first compressor and a second compressor operationally connected for tandem operation as part of a first circuit having first heat transfer devices;

wherein the second compressor assembly comprises at least a third compressor comprising a part of a second circuit having second heat transfer devices separated from the first heat transfer devices;

operating, by the controller in a first mode of operation, the first compressor in an ON-state and the second compressor in an OFF-state during the second demand stage;

operating, by the controller in response to an increase in load demand on the HVAC compressor assembly from the lower demand stage to the higher demand stage, the first compressor in an OFF-state and the second compressor in an OFF-state to keep the first compressor and the second compressor idle for a first time period, and wherein the first time period allows lubricant levels to equalize between the first compressor and the second compressor;

operating, by the controller during the first time period, the third compressor in an ON-state to utilize the heat transfer capacity of the second heat transfer devices on the second circuit; and operating, by the controller following expiration of the first time period, the first compressor and the second compressor in an ON-state in the higher demand stage to meet the increased load demand.

16. The method of claim 15, wherein the load demand on the HVAC compressor assembly in the higher demand stage is a full load; and operating, by the controller following the expiration of the first time period, the HVAC compressor assembly at the full capacity of the HVAC compressor assembly in the higher demand stage.

17. The method of claim 15, further comprising:

operating, by the controller, the HVAC compressor assembly in the first mode or at least a second mode based on an ambient temperature measured outside the enclosed space;

operating, by the controller in response to measurement of the ambient temperature at or above a mode transition temperature ("MTT"), the HVAC compressor assembly in the first mode, and operating, by the controller in response to measurement of the ambient temperature below the MTT, the HVAC compressor assembly in the second mode; and wherein the MTT is selected based on the ambient temperature at which a sump superheat of the HVAC system operating in the second demand stage is at or above about 20 degrees Fahrenheit.

18. The method of claim 17, wherein the MTT comprises about 65 degrees Fahrenheit.

19. The method of claim 17, further comprising:

operating, by the controller in response to a first decreased load demand on the HVAC compressor assembly from the higher demand stage to the lower demand stage, the first compressor in an ON-state and the second compressor in an OFF-state in the first mode of operation, and operating, by the controller, the third compressor in an ON-state to utilize the heat transfer capacity of the second heat transfer devices on the second circuit in conjunction with the heat transfer capacity of the first heat transfer devices on the first circuit.

20. The method of claim 19, further comprising:

wherein the second compressor assembly further comprises a second tandem compressor assembly having the third compressor and a fourth compressor operationally connected for tandem operation as part of the second circuit;

operating, by the controller in the second mode of operation, the first compressor in an OFF-state, the second compressor in an OFF-state, the third compressor in an ON-state, and the fourth compressor in an ON-state during the lower demand stage; and operating, by the controller in response to an increase in load demand on the HVAC compressor assembly from the lower demand stage to the higher demand stage in the second mode of operation, the first compressor, the second compressor, the third compressor, and the fourth compressor in an ON-state in the higher demand stage to meet the increased load demand.

* * * * *